US007736475B2

(12) United States Patent
Sandoval et al.

(10) Patent No.: US 7,736,475 B2
(45) **Date of Patent: *Jun. 15, 2010**

(54) SYSTEM AND METHOD FOR PRODUCING COPPER POWDER BY ELECTROWINNING USING THE FERROUS/FERRIC ANODE REACTION

(75) Inventors: Scot P Sandoval, Morenci, AZ (US); Antonioni C Stevens, Thatcher, AZ (US); Timothy G Robinson, Scottsdale, AZ (US); John O Marsden, Phoenix, AZ (US); Stanley R Gilbert, Thatcher, AZ (US)

(73) Assignee: Freeport-McMoran Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/332,641

(22) Filed: Dec. 11, 2008

(65) Prior Publication Data

US 2009/0145749 A1 Jun. 11, 2009

Related U.S. Application Data

(63) Continuation of application No. 11/160,910, filed on Jul. 14, 2005, now Pat. No. 7,494,580, which is a continuation-in-part of application No. 10/629,497, filed on Jul. 28, 2003, now Pat. No. 7,378,011.

(60) Provisional application No. 60/590,882, filed on Jul. 22, 2004.

(51) Int. Cl.

| | |
|---|---|
| ***C25B 15/08*** | (2006.01) |
| ***C25B 15/02*** | (2006.01) |
| ***C25B 9/00*** | (2006.01) |
| ***C25B 9/06*** | (2006.01) |

(52) U.S. Cl. ..... 204/237; 204/232; 204/242; 204/267; 204/269; 204/275.1; 204/278.5

(58) Field of Classification Search ..... 204/242, 204/267, 269, 275.1, 278.5, 281, 284, 220, 204/224 R, 232, 237; 205/574, 575, 576, 205/580, 584, 586, 583, 579, 577, 588, 602, 205/603

See application file for complete search history.

(56) References Cited

U.S. PATENT DOCUMENTS 2,792,342 A 5/1957 Tuwiner (Continued)

OTHER PUBLICATIONS

Marracino, et al.; "A First Investigation of Flow-Through Porous Electrodes Made of Metallic Felts or Foams"; Electrochimica Acta, Vo. 32, No. 9, pp. 1303-1309; 1987.

(Continued)

OTHER PUBLICATIONS

Alkire, et al.; "Flow-Through Porous Electrodes", J. Electrochem. Soc.; vol. 122, No. 12, pp. 1594-1601; Dec. 1975.

(Continued)

*Primary Examiner*—Bruce F Bell
(74) *Attorney, Agent, or Firm*—Snell & Wilmer L.L.P.

(57) ABSTRACT

The present invention relates, generally, to a method for electrowinning copper powder, and more particularly to a method for electrowinning copper powder from a copper-containing solution using the ferrous/ferric anode reaction. In accordance with various embodiments of the present invention, a process for producing copper powder by electrowinning employs alternative anode reaction technology, namely, the ferrous/ferric anode reaction, and enables the efficient and cost-effective production of copper powder at a total cell voltage of less than about 1.5 V and at current densities of greater than 50 A/ft$^2$. A copper powder electrowinning process in accordance with the present invention also reduces or eliminates acid mist generation that is characteristic of electrowinning operations utilizing conventional electrowinning chemistry (e.g., oxygen evolution at the anode), which is advantageous.

19 Claims, 9 Drawing Sheets

U.S. PATENT DOCUMENTS 3,262,870 A 7/1966 Harlan
3,616,277 A 10/1971 Adamson et al.
3,632,498 A 1/1972 Beer
3,703,358 A 11/1972 Carson et al.
3,711,385 A 1/1973 Beer
3,853,724 A 12/1974 Wojeik et al.
3,876,516 A 4/1975 Pace et al.
3,887,396 A 6/1975 Walsh et al.
3,915,834 A 10/1975 Wright et al.
3,956,086 A 5/1976 Wilkinson et al.
3,972,795 A 8/1976 Goens et al.
3,979,275 A 9/1976 Harvey et al.
3,981,353 A 9/1976 Knight
4,071,431 A 1/1978 Nicou et al.
4,098,668 A 7/1978 Andersen et al.
4,129,494 A 12/1978 Norman
4,201,653 A 5/1980 O'Neill et al.
4,219,401 A 8/1980 Johnson
4,226,685 A 10/1980 Portal et al.
4,272,339 A 6/1981 Knight et al.
4,278,521 A 7/1981 Kreysa
4,288,305 A 9/1981 Garrietsen et al.
4,292,160 A 9/1981 Marcantonio
4,318,789 A * 3/1982 Marcantonio ..... 588/302
4,373,654 A 2/1983 Prengaman et al.
4,399,020 A 8/1983 Branchick et al.
4,436,601 A 3/1984 Branchick et al.
4,445,990 A 5/1984 Kim et al.
4,515,672 A 5/1985 Platek et al.
4,556,469 A 12/1985 Kim et al.
4,560,453 A 12/1985 Hoffman et al.
4,565,748 A 1/1986 Dahl
4,680,100 A 7/1987 Morin
4,715,934 A 12/1987 Tamminen
4,762,603 A 8/1988 Morin
4,776,941 A 10/1988 Tezanos et al.
4,789,450 A 12/1988 Paterson
4,834,850 A 5/1989 deNora et al.
4,863,580 A 9/1989 Epner
4,960,500 A 10/1990 Epner
5,006,216 A 4/1991 Dietrich et al.
5,128,012 A 7/1992 Olsen
5,133,843 A 7/1992 Eisman
5,277,777 A 1/1994 Olper et al.
5,292,412 A 3/1994 Pitton
5,324,409 A 6/1994 Mayr et al.
5,368,702 A 11/1994 deNora
5,454,917 A 10/1995 Mattison et al.
5,458,746 A 10/1995 Burgess et al.
5,492,608 A 2/1996 Sandoval et al.
5,516,412 A 5/1996 Andricacos et al.
5,622,615 A 4/1997 Young et al.
5,690,806 A 11/1997 Sunderland et al.
5,705,048 A 1/1998 Oxley et al.
5,725,752 A 3/1998 Sunderland et al.
5,770,037 A 6/1998 Goto et al.
5,783,050 A 7/1998 Coin et al.
5,837,122 A 11/1998 Snyder et al.
5,877,388 A 3/1999 Enda et al.
5,882,502 A 3/1999 Gomez
5,908,540 A 6/1999 Fanti
5,972,181 A 10/1999 Coin et al.
6,017,428 A 1/2000 Hill et al.
6,086,691 A 7/2000 Lehockey et al.
6,086,733 A 7/2000 Carey et al.
6,113,758 A 9/2000 deNora et al.
6,139,705 A 10/2000 Brown, Jr. et al.
6,149,797 A 11/2000 Carey et al.
6,214,179 B1 4/2001 Cartner
6,231,730 B1 5/2001 Davis et al.
6,319,389 B1 11/2001 Fountain et al.
6,340,423 B1 1/2002 Duyvesteyn
6,352,622 B1 3/2002 Brown et al.
6,398,939 B1 6/2002 Huens et al.
6,402,930 B1 6/2002 Allen et al.
6,451,183 B1 9/2002 Treasure et al.
7,368,049 B2 5/2008 Sandoval et al.
7,378,010 B2 5/2008 Stevens et al.
7,378,011 B2 5/2008 Sandoval et al.
7,393,438 B2 * 7/2008 Marsden et al. ..... 204/269
7,452,455 B2 * 11/2008 Sandoval et al. ..... 205/579
7,494,580 B2 * 2/2009 Sandoval et al. ..... 205/576
2004/0168909 A1 9/2004 Larson
2005/0023151 A1 2/2005 Sandoval et al.
2005/0269209 A1 12/2005 Sandoval et al.
2006/0021880 A1 * 2/2006 Sandoval et al. ..... 205/576
2006/0226024 A1 10/2006 Sandoval et al.
2008/0047839 A1 * 2/2008 Sandoval et al. ..... 205/577
2008/0105556 A1 * 5/2008 Sandoval et al. ..... 205/148
2008/0217185 A1 * 9/2008 Stevens et al. ..... 205/586

FOREIGN PATENT DOCUMENTS

CA 1162514 2/1984
DE 19731616 1/1999
EP 0206941 10/1990
EP 0129845 10/1998
FR 2810681 12/2001
JP 02-229778 9/1990
RU 1813806 5/1993
RU 2169443 6/2001
SU 589290 1/1978
SU 715900 2/1980
SU 1708939 1/1982
SU 1090760 5/1984
SU 1183566 10/1984
SU 1243907 7/1986
SU 1346697 10/1987
SU 1418349 8/1988
SU 2121411 11/1988
SU 1537711 1/1990
SU 1708939 1/1992
WO WO 97/14825 4/1997
WO WO 00/43576 7/2000
WO WO 2005/012597 2/2005

OTHER PUBLICATIONS

Popov, et al.; "The comparison of galvanostatic and potentiostatic copper powder deposition on platinum and aluminum electrodes"; Journal of Applied Electrochemistry, vol. 8, Jan. 3, 1978; pp. 503-514.

Jian Qi, et al.; "Analysis of flow-through porous electrode cell with homogenous chemical reactions: application to bromide oxidation in brine solutions"; Journal of Applied Electrochemistry, Vo. 23, revised Jan. 8, 1993; pp. 873-886.

Saleh, et al.; "Electrowinning of Non-Noble Metals with Simultaneous Hydrogen Evolution at Flow-Through Porous Electrodes", J. Electrochem. Soc., vol. 142, No. 12, Dec. 1995; pp. 4122-4128.

Smirnov, et al.; "Theory, Production Technology, and Properties of Powders and Fibers"; Ural Scientific-Research and Design Institute of the Copper Industry; Translated from Poroshkovaya Metallurgiya, No. 3(291), pp. 1-4, Mar. 1987, original article submitted Mar. 25, 1986.

Usol'Tseva, et al.; "Production of Electrolytic Copper Powders on Rod Electrodes With Separating Layers"; Ural Polytechnic Institute; Translated from Poroshkovaya Metallurgiya, No. 11(299), pp. 4-8, Nov. 1987; original article submitted Dec. 29, 1986.

Allen, et al.; "Energy Savings by Means of Fuel Cell Electrodes in Electro-Chemical Industries", Dept. of Energy, Journal Announcement: GRAI8018; NSA0500, Mar. 19, 1979, p. 72.

Barbosa, et al.; "On-line coupling of electrochemical preconcentration in tungsten coil electrothermal atomic absorption spectrometry for determination of lead in natural waters", Spectrochimica Acta—Part B Atomic Spectroscopy, v. 54, n 8, 1999, p. 1155-1166.

Bechtold, et al.; "Optimization of multi-cathode membrane electrolyzers for the indirect electrochemical reduction of indigo"; Chemical Engineering & Technology, v. 21, n. 11, Nov. 1998; pp. 877-880.

Chin, Der-Tau; "Metal recovery from wastewater with an electrochemical method", Chemical Engineering Education, v. 36, No. 2, Spring 2002.

Cook, et al.; "Electrodeposition of copper in flow-through cathodes"; Abstract from Electrochemical Society Fall Meeting; pp. 76-77; Oct. 17-22, 1976.

Ford, et al.; "User Data Package for Implementation of Electrolytic Recovery Technology in Navy Electroplating Shops"; Naval Facilities Engineering Service Center, Report No. NFESC-TR-2046-ENV, Oct. 1995, 83p.

Jorne, et al.; "Suppression of Dendrites and Roughness During Electrodeposition by Impinging Flow"; Journal of the Electrochemical Society, v. 134, n6, Jun. 1987, p. 1399-1402.

Lemon, et al.; "3-D Electrolytic Cell Provides New Option for Wastewater Recycle & Waste Minimization"; Renovare International, Inc., AESF/EPA Conference for Environmental Excellence—Jan. 2000.

Scholder, et al.; "Study of a Porous Cathode with Stacked Woven Screens"; Abstract—34th Meeting of International Society of Electrochemistry; Sep. 18, 1983.

Wiechmann, et al.; "The use of segmented intercell bars in electrowinning plants"; Electrometallurgy 2001, pp. 261-272.

Sandoval, et al.; "A substituted anode reaction for electrowinning copper"; Proceedings of COPPER95-COBRE 95 International Conference, vol. III—Electrorefining and Hydrometallurgy of Copper, pp. 423-435.

Sandoval, et al.; "Evaluation of the Ferrous/Ferric-Sulfur Dioxide Anode Reaction for Integration Into the Copper Leaching-Solvent Extraction-Electrowinning Circuit"; Chapter 66, Reno Research Center, U.S. Bureau of Mines, pp. 1091-1105.

Duby, Paul; "The History of Progress in Dimensionally Stable Anodes", JOM, Mar. 1993, pp. 41-43.

Dolinar, et al.; "Copper Electrowinning in the Absence of Acid Misting Using the Ferrous/Ferric-Sulfur Dioxide Anode Reaction—A Pilot Study"; Society for Mining, Metallurgy and Exploration, Inc., Transactions vol. 298, pp. 1936-1942, SME Annual Meeting, Mar. 6-9, 1995.

Smith, et al.; "Electrowinning/electrostripping and electrodialysis processes for the recovery and recycle of metals from plating rinse solutions"; Abstract from Proceedings of 9th Symposium on Separation Science and Technology for Energy Applications; Oct. 22-26, 1995.

Varentsov, et al.; "Electrochemical Extraction of Copper from Dilute Sulfuric Acid Solutions Onto Fibrous Graphite Flow-Through Cathodes"; Soviet Electrochemistry, v. 18, n. 3, Mar. 1982, p. 326-329 (Abstract only).

Zamyatin, et al.; "Experimental Study of the Factors Governing the Efficiency of Porous Cathodes in metal Extraction from Dilute Solutions"; Soviet Electrochemistry, v. 20, n. 6, Jun. 1984, p. 795-797 (Abstract only).

International Search Report/Written Opinion dated Feb. 16, 2007 in PCT/US2005/025228.

International Preliminary Report on Patentability dated Mar. 29, 2007 in PCT/US2005/025228.

International Search Report dated Jul. 13, 2005 ISA: European Patent Office in PCT/US2004/024162.

Notice of Allowance dated Oct. 29, 2009 in U.S. Appl. No. 12/126,559.

The International Preliminary Report on Patentability dated Feb. 22, 2006 in PCT/US2004/024162.

* cited by examiner

SYSTEM AND METHOD FOR PRODUCING COPPER POWDER BY ELECTROWINNING USING THE FERROUS/FERRIC ANODE REACTION

CROSS REFERENCE TO RELATED APPLICATIONS

This application is a continuation of U.S. application Ser. No. 11/160,910, filed on Jul. 14, 2005 now U.S. Pat. No. 7,494,580 and entitled, "System And Method For Producing Copper Powder By Electrowinning Using The Ferrous/Ferric Anode Reaction." The '910 application is a continuation-in-part of U.S. application Ser. No. 10/629,497, now U.S. Pat. No. 7,378,011, filed on Jul. 28, 2003 and entitled "Method & Apparatus for Electrowinning Copper Using the Ferrous/Ferric Anode Reaction." The '910 application also claims priority to U.S. Provisional Application No. 60/590,882, filed on Jul. 22, 2004. All the above referenced applications are hereby incorporated by reference in their entirety.

FIELD OF INVENTION

This invention relates to a system and method for producing copper powder by electrowinning. In particular, this invention relates to a system and method for producing a copper powder product using the ferrous/ferric anode reaction.

BACKGROUND OF THE INVENTION

Efficiency and cost-effectiveness of copper electrowinning is and for a long time has been important to the competitiveness of the domestic copper industry. Past research and development efforts in this area have thus focused—at least in part—on mechanisms for decreasing the total energy requirement for copper electrowinning, which directly impacts the cost-effectiveness of the electrowinning process.

In conventional copper electrowinning processes the following reactions occur:

Cathode Reaction:

$$Cu^{2+}+SO_4^{2-}+2e^-\rightarrow Cu^0+SO_4^{2-}\ (E^0=+0.345\ V)$$

Anode Reaction:

$$H_2O\rightarrow \tfrac{1}{2}O_2+2H^++2e^-\ (E^0=-1.230\ V)$$

Overall Cell Reaction:

$$Cu^{2+}+SO_4^{2-}+H_2O\rightarrow Cu^0+2H^++SO_4^{2-}+\tfrac{1}{2}O_2\ (E^0=-0.885\ V)$$

Copper electrowinning according to the above reactions, while desirable in some applications, exhibits several areas of potential improvement for, among other things, improved economics, increased efficiency, and reduced acid mist generation. First, in conventional copper electrowinning, the decomposition of water reaction at the anode produces oxygen ($O_2$) gas. When the liberated oxygen gas bubbles break the surface of the electrolyte bath, they create an acid mist. Reduction or elimination of acid mist is desirable. Second, the decomposition of water anode reaction used in conventional electrowinning contributes significantly to the overall cell voltage via the anode reaction equilibrium potential and the overpotential. The decomposition of water anode reaction exhibits a standard potential of 1.23 Volts (V), which contributes significantly to the total voltage required for conventional copper electrowinning. The typical overall cell voltage is approximately 2.0 V. Decreasing the anode reaction equilibrium potential and/or overpotential can reduce cell voltage, and thus conserve energy by decreasing the total operating costs of the electrowinning operation.

One way that has been found to potentially reduce the energy requirement for copper electrowinning is to use alternative anode reaction electrowinning (i.e., oxidation of ferrous ion to ferric ion at the anode), which occurs by the following reactions:

Cathode Reaction:

$$Cu^{2+}+SO_4^{2-}+2e^-\rightarrow Cu^0+SO_4^{2-}\ (E^0=+0.345\ V)$$

Anode Reaction:

$$2Fe^{2+}\rightarrow 2Fe^{3+}+2e^-\ (E^0=-0.770\ V)$$

Overall Cell Reaction:

$$Cu^{2+}+SO_4^{2-}+2Fe^{2+}\rightarrow Cu^0+2Fe^{3+}+SO_4^{2-}\ (E^0=-0.425\ V)$$

The ferric iron generated at the anode as a result of this overall cell reaction can be reduced back to ferrous iron (i.e., "regenerated") using sulfur dioxide, as follows:

Solution Reaction:

$$2Fe^{3+}+SO_2+2H_2O\rightarrow 2Fe^{2+}+4H^++SO_4^{2-}$$

The use of the ferrous/ferric anode reaction in copper electrowinning cells lowers the energy consumption of those cells as compared to conventional copper electrowinning cells that employ the decomposition of water anode reaction, since the oxidation of ferrous iron ($Fe^{2+}$) to ferric iron ($Fe^{3+}$) occurs at a lower voltage than does the decomposition of water.

Conventional copper electrowinning processes produce solid copper cathode sheets. Copper powder, however, is an alternative to solid copper cathode sheets. Production of copper powder as compared to copper cathode sheets can be advantageous in a number of ways. For example, it is potentially easier to remove and handle copper powder from an electrowinning cell, as opposed to handling relatively heavy and bulky copper cathode sheets.

In traditional electrowinning operations yielding copper cathode sheets, harvesting typically occurs every five to eight days, depending upon the operating parameters of the electrowinning apparatus. Copper powder production has the potential, however, of being a continuous or semi-continuous process, so harvesting may be performed on a substantially continuous basis, therefore reducing the amount of "work-in-process" inventory as compared to conventional copper cathode production facilities. Also, there is potential for operating copper electrowinning processes at higher current densities when producing copper powder than with conventional electrowinning processes that produce copper cathode sheets, capital costs for the electrowinning cell equipment may be less on a per unit of production basis, and it also may be possible to lower operating costs with such processes. It is also possible to electrowin copper effectively from solutions containing lower concentrations of copper than using conventional electrowinning at acceptable efficiencies. Moreover, copper powder exhibits superior melting characteristics over copper cathode sheets and copper powder may be used in a wider variety of products and applications than can conventional copper cathode sheets. For example, it may be possible to directly form rods, shapes, and other copper and copper alloy products from copper powder. Copper powder can also be melted directly or briquetted prior to melting and conventional rod production.

Although, in general, the use of the ferrous/ferric anode reaction in connection with copper electrowinning is known, use of the ferrous/ferric anode reaction in connection with the electrowinning of copper powder is not known. What is needed is an effective and efficient process for producing a high-quality, saleable copper powder product that exhibits the advantages of alternative anode reaction electrowinning chemistry.

SUMMARY OF THE INVENTION

In accordance with various embodiments of the present invention, copper powder may be produced and harvested using alternative anode reaction electrowinning chemistry (i.e., oxidation of ferrous ion to ferric ion at the anode), including using direct electrowinning techniques (i.e., electrowinning copper from copper-containing solution without the use of solvent extraction or without the use of other methods for concentration of copper in solution, such as ion exchange, ion selective membrane technology, solution recirculation, evaporation, and other methods). Additionally, various aspects of the present invention enable enhancements in process ergonomics and process safety while achieving improved process economics.

While the way in which the present invention addresses the deficiencies of the prior art and provides the above-mentioned and other advantages will be discussed in greater detail below, in general, the present invention provides a method for producing copper powder by electrowinning using an alternative anode reaction process.

In accordance with various exemplary embodiments of the present invention, the process and apparatus for electrowinning copper powder from a copper-containing solution using alternative anode reaction technology may be configured to optimize copper powder particle size and/or size distribution, to optimize cell operating voltage, cell current density, and overall power requirements, to maximize the ease of harvesting copper powder from the cathode, and/or to optimize copper concentration in the lean electrolyte stream leaving the electrowinning operation.

In accordance with other aspects of the invention, process stages and operating parameters are designed to optimize copper powder quality, particularly with regard to the level of surface oxidation of the copper powder particles, and, optionally, the particle size distribution and physical properties of the final copper powder product.

The present invention relates to a copper electrowinning process designed to address, among other things, various deficiencies in prior art electrowinning systems and provide a method of producing copper powder by electrowinning using the ferrous/ferric anode reaction. The process disclosed herein achieves an advancement in the art by providing a copper powder electrowinning system that, by utilizing the ferrous/ferric anode reaction in combination with other aspects of the invention, enables significant enhancement in electrowinning efficiency, energy consumption, and reduction of acid mist generation as compared to other copper electrowinning processes. As used herein, the term "alternative anode reaction" refers to the ferrous/ferric anode reaction, and the term "alternative anode reaction process" refers to any electrowinning process in which the ferrous/ferric anode reaction is employed.

These and other advantages of a process according to various aspects and embodiments of the present invention will be apparent to those skilled in the art upon reading and understanding the following detailed description with reference to the accompanying figures.

BRIEF DESCRIPTION OF THE DRAWING FIGURES

The subject matter of the present invention is particularly pointed out and distinctly claimed in the concluding portion of the specification. A more complete understanding of the present invention, however, may best be obtained by referring to the detailed description and claims when considered in connection with the drawing figures, wherein like numerals denote like elements and wherein:

DETAILED DESCRIPTION OF THE INVENTION

The detailed description of various exemplary embodiments of the invention herein makes reference to the accompanying drawing figures. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

As an initial matter, it should be understood that various embodiments of the present invention may be successfully employed to produce high quality copper powder from copper-containing solutions using alternative anode reaction electrowinning chemistry.

In general, processes and systems configured according to various embodiments of the present invention enable the efficient and cost-effective utilization of the alternative anode reaction in electrowinning of copper powder at a cell voltage of less than about 1.5 V. Furthermore, the use of such processes and/or systems reduces generation of acid mist.

Figure 1:
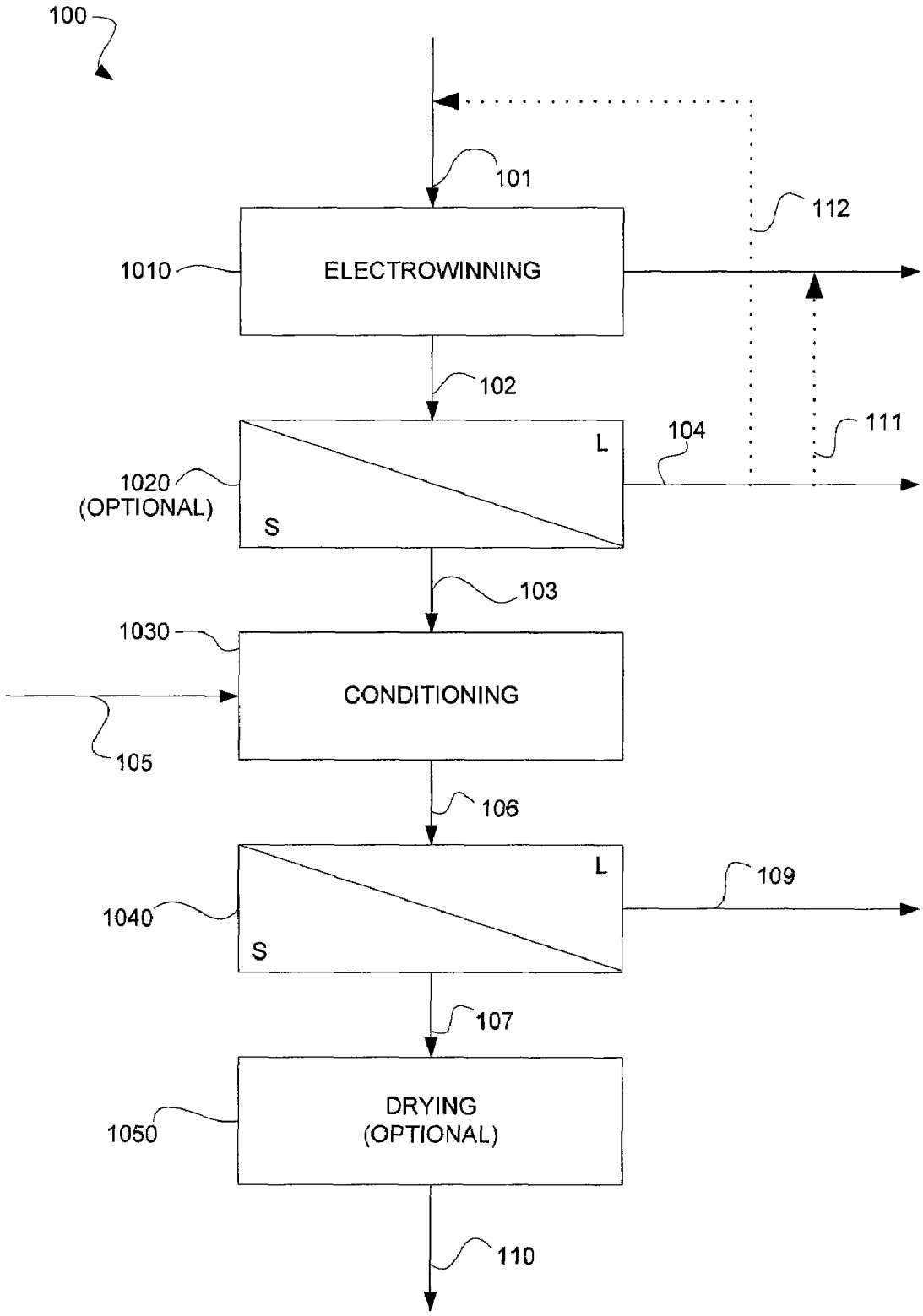
FIG. 1 is a flow diagram illustrating various aspects of a process for producing copper powder in accordance with one exemplary embodiment of the present invention.

With initial reference to FIG. 1, copper powder process 100 comprises an electrowinning stage 1010 in which copper powder is electrowon from a copper-containing solution 101 using the ferrous/ferric anode reaction to produce a copper powder slurry stream 102.

In accordance with one aspect of an exemplary embodiment of the invention, a copper-containing solution 101 is introduced into an electrowinning cell, and copper is electrowon from the solution to form copper powder. A copper powder slurry stream 102, which comprises the copper powder product and electrolyte, is collected and removed from the electrowinning cell, while a lean electrolyte stream 108 exits the electrowinning cell from a side or top portion of the apparatus, preferably from an area generally opposite the entry point of the copper-containing solution to the apparatus. Optionally, in accordance with one exemplary embodiment of the invention, the lean electrolyte exiting the electrowinning apparatus may be subjected to filtration to remove suspended copper particles before being recycled to the electrowinning apparatus, utilized in other processing areas, or disposed of. Moreover, the rich electrolyte entering the electrowinning apparatus may be subjected to filtration prior to electrowinning to remove any undesirable solid and/or liquid impurities (including organic liquid impurities). When utilized, the degree of filtration desired generally will be determined by the purity needs of the final copper powder product (in the case of filtration prior to electrowinning), the needs of other processing operations, and/or the amount of solid and/or liquid impurities present in the stream(s).

In accordance with one aspect of the invention, ferrous iron, for example, in the form of ferrous sulfate ($FeSO_4$), is added to the copper-rich electrolyte to be subjected to electrowinning, to cause the ferrous/ferric ($Fe^{2+}/Fe^{3+}$) couple to become the anode reaction. In so doing, the ferrous/ferric anode reaction may replace the decomposition of water anode reaction (i.e., "conventional" electrowinning chemistry). As discussed above, because there is no oxygen gas produced in the ferrous/ferric anode reaction, generation of "acid mist" as a result of the reactions in the electrowinning cell is eliminated. In addition, because the equilibrium potential of the $Fe^{2+}/Fe^{3+}$ couple (i.e., $E^0=-0.770$ V) is less than that for the decomposition of water (i.e., $E^0=-1.230$ V), the cell voltage is decreased, thereby decreasing cell energy consumption.

Anode Characteristics

In general, any anode configuration now known or hereafter devised suitable to achieve the processing parameters and objectives described herein may be used in accordance with various embodiments of the present invention. As such, various embodiments of the present invention may utilize conventional "plate"-type (i.e., non-flow-through) anodes, other flow-through or non-flow-through anodes of various geometries (e.g., cylindrical anodes), flow-through anodes, or a combination of types within one or more electrowinning cells. Any anode, however, that enables electrowinning of copper powder from a copper-containing solution using the ferrous/ferric anode reaction may be employed in connection with the present invention.

In accordance with one exemplary embodiment of the invention, however, at least one flow-through anode is utilized in connection with the electrowinning cell. As used herein, the term "flow-through anode" refers to any anode configured to enable electrolyte to pass through it. While fluid flow from the electrolyte entry point and/or any other electrolyte flow mechanisms incorporated into the electrowinning cell provide electrolyte movement, a flow-through anode allows the electrolyte in the electrowinning cell to flow through the anode during the electrowinning process.

When a flow-through anode is utilized, any now known or hereafter devised flow-through anode may be utilized in accordance with various exemplary embodiments of the present invention. Possible configurations include, but are not limited to, metal, metal wool, metal fabric, other suitable conductive nonmetallic materials (e.g., carbon materials), an expanded porous metal structure, metal mesh, expanded metal mesh, corrugated metal mesh, multiple metal strips, multiple metal wires or rods, woven wire cloth, perforated metal sheets, and the like, or combinations thereof. Moreover, suitable anode configurations are not limited to planar configurations, but may include any suitable multiplanar geometric configuration.

Anodes employed in conventional electrowinning operations typically comprise lead or a lead alloy, such as, for example, Pb—Sn—Ca. One significant disadvantage of using such anodes is that, during the electrowinning operation, small amounts of lead are released from the surface of the anode and ultimately cause the generation of undesirable sediments, "sludges," particulates suspended in the electrolyte, other corrosion products, or other physical degradation products in the electrowinning cell and contamination of the copper product. For example, copper produced in operations employing a lead-containing anode typically comprises lead contaminant at a level of from about 0.5 ppm to about 15 ppm. In accordance with one aspect of a preferred embodiment of the present invention, the anode is substantially lead-free. Thus, generation of lead-containing sediments, "sludges," particulates suspended in the electrolyte, or other corrosion or physical degradation products and resultant contamination of the copper powder with lead from the anode is avoided. In conventional electrowinning processes using such lead anodes, another disadvantage is the need for cobalt to control the surface corrosion characteristics of the anode, to control the formation of lead oxide, and/or to prevent the deleterious effects of manganese in the system.

In accordance with one aspect of an exemplary embodiment of the invention, the anode is formed of one of the so-called "valve" metals, including titanium (Ti), tantalum (Ta), zirconium (Zr), or niobium (Nb). The anode may also be formed of other metals, such as nickel (Ni), stainless steel (e.g., Type 316, Type 316L, Type 317, Type 310, etc.), or a metal alloy (e.g., a nickel-chrome alloy), intermetallic mixture, or a ceramic or cermet containing one or more valve metals. For example, titanium may be alloyed with nickel, cobalt (Co), iron (Fe), manganese (Mn), or copper (Cu) to form a suitable anode. Preferably, in accordance with one exemplary embodiment, the anode comprises titanium, because, among other things, titanium is rugged and corrosion-resistant. Titanium anodes, for example, when used in accordance with various embodiments of the present invention, potentially have useful lives of up to fifteen years or more.

The anode may also optionally comprise any electrochemically active coating. Exemplary coatings include those provided from platinum, ruthenium, iridium, or other Group VIII metals, Group VIII metal oxides, or compounds comprising Group VIII metals, and oxides and compounds of titanium, molybdenum, tantalum, and/or mixtures and combinations thereof. Ruthenium oxide and iridium oxide are two preferred compounds for use as an electrochemically active coating on titanium anodes.

In accordance with another aspect of an exemplary embodiment of the invention, the anode comprises a titanium mesh (or other metal, metal alloy, intermetallic mixture, or ceramic or cermet as set forth above) upon which a coating comprising carbon, graphite, a mixture of carbon and graphite, a precious metal oxide, or a spinel-type coating is applied. Preferably, in accordance with one exemplary embodiment, the anode comprises a titanium mesh with a coating comprised of a mixture of carbon black powder and graphite powder.

In accordance with an exemplary embodiment of the invention, the anode comprises a carbon composite or a metal-graphite sintered material wherein the exemplary metal described is titanium. In accordance with other embodiments of the invention, the anode may be formed of a carbon composite material, graphite rods, graphite-carbon coated metallic mesh and the like. Moreover, a metal in the metallic mesh or metal-graphite sintered exemplary embodiment is described herein and shown by example using titanium; however, any metal may be used without detracting from the scope of the present invention. Exemplary embodiments of such anodes are set forth in various of the Examples herein.

In accordance with one exemplary embodiment, a wire mesh may be welded to the conductor rods, wherein the wire mesh and conductor rods may comprise materials as described above for anodes. In one exemplary embodiment, the wire mesh comprises of a woven wire screen with 80 by 80 strands per square inch, however various mesh configurations may be used, such as, for example, 30 by 30 strands per square inch. Moreover, various regular and irregular geometric mesh configurations may be used. In accordance with yet another exemplary embodiment, a flow-through anode may comprise a plurality of vertically-suspended stainless steel rods, or stainless steel rods fitted with graphite tubes or rings. In accordance with another aspect of an exemplary embodiment, the hanger bar to which the anode body is attached comprises copper or a suitably conductive copper alloy, aluminum, or other suitable conductive material.

Cathode Characteristics

In general, any cathode configuration now known or hereafter devised suitable to achieve the processing parameters and objectives described herein may be used in accordance with various embodiments of the present invention. As such, various embodiments of the present invention may utilize conventional "plate"-type (i.e., non-flow-through) cathodes, flow-through cathodes, or a combination of types within one or more electrowinning cells. Any cathode, however, that enables electrowinning of copper powder from a copper-containing solution may be employed in connection with the present invention.

In accordance with one exemplary embodiment of the invention, however, at least one flow-through cathode is utilized in connection with the electrowinning cell. For purposes of this detailed description of preferred embodiments of the invention, the term "cathode" refers to a complete positive electrode assembly (typically connected to a single bar). For example, in a cathode assembly comprising multiple thin rods suspended from a bar, the term "cathode" is used to refer to the group of thin rods, and not to a single rod. In accordance with one exemplary embodiment of the present invention, a flow-through cathode is incorporated into the electrowinning apparatus. As used herein, the term "flow-through cathode" refers to any cathode configured to enable electrolyte to pass through it.

Various flow-through cathode configurations may be suitable, including: (1) multiple parallel metal wires, thin rods, including hexagonal rods or other geometries, (2) multiple parallel metal strips either aligned with electrolyte flow or inclined at an angle to flow direction, (3) metal mesh, (4) expanded porous metal structure, (5) metal wool or fabric, and/or (6) conductive polymers. The cathode may be formed of copper, copper alloy, stainless steel, titanium, aluminum, or any other metal or combination of metals and/or other materials. The surface finish of the cathode (e.g., whether polished or unpolished) may affect the harvestability of the copper powder. Accordingly, polishing or other surface finishes, surface coatings, surface oxidation layer(s), or any other suitable barrier layer may advantageously be employed to enhance harvestability.

In accordance with various embodiments of the present invention, the cathode may be configured in any manner now known or hereafter devised by the skilled artisan.

All or substantially all of the total surface area of the portion of the cathode that is immersed in the electrolyte during operation of the electrowinning cell is referred to herein, and generally in the literature, as the "active" surface area of the cathode. This is the portion of the cathode onto which copper powder is formed during electrowinning.

In accordance with one aspect of an exemplary embodiment of the invention, an electrowinning apparatus comprises multiple electrowinning cells configured in series or otherwise electrically connected, each comprising a series of electrodes-alternating anodes and cathodes. In accordance with one aspect of an exemplary embodiment, each electrowinning cell or portion of an electrowinning cell comprises between about 4 and about 80 anodes and between about 4 and about 80 cathodes. In accordance with one aspect of another exemplary embodiment, each electrowinning cell or portion of an electrowinning cell comprises from about 15 to about 40 anodes and about 16 to about 41 cathodes. However, it should be appreciated that in accordance with the present invention, any number of anodes and/or cathodes may be utilized.

Each electrowinning cell or portions of each electrowinning cell may preferably be configured with a base portion having a collecting configuration, such as, for example, a conical-shaped or trench-shaped base portion, which collects the copper powder product harvested from the cathodes for removal from the electrowinning cell.

In accordance with one aspect of an exemplary embodiment of the invention, the anodes and cathodes in the electrowinning cell are spaced evenly across the cell, and are maintained as close as possible to optimize power consumption and mass transfer while minimizing electrical short-circuiting of current between the electrodes. While anode/cathode spacing in conventional electrowinning cells is typically about 2 inches or greater from anode to cathode, electrowinning cells configured in accordance with various aspects of the present invention preferably exhibit anode/cathode spacing of from about 0.5 inch to about 4 inches, and preferably less than about 2 inches. More preferably, an electrowinning cell configured in accordance with an exemplary embodiment of the present invention exhibits anode/cathode spacing of about or less than about 1.5 inches. As used herein, "anode/cathode spacing" is measured from the centerline of an anode hanger bar to the centerline of the adjacent cathode hanger bar.

Electrolyte Flow Characteristics

While various configurations and combinations of anodes and cathodes in the electrowinning cell may be used effectively in connection with various embodiments of the invention, preferably a flow-through anode is used and electrolyte circulation is provided using an electrolyte flow manifold capable of maintaining satisfactory flow and circulation of electrolyte within the electrowinning cell. Generally speaking, any electrolyte pumping, circulation, or agitation system capable of maintaining satisfactory flow and circulation of electrolyte between the electrodes in an electrowinning cell such that the process specifications described herein are practical may be used in accordance with various embodiments of the invention.

In accordance with an exemplary embodiment of the invention, the electrolyte flow rate is maintained at a level of from about 0.05 gallons per minute per square foot of active cathode to about 30 gallons per minute per square foot of active cathode. Preferably, the electrolyte flow rate is maintained at a level of from about 0.1 gallons per minute per square foot of active cathode to about 0.75 gallons per minute per square foot of active cathode. It should be recognized that the optimal operable electrolyte flow rate useful in accordance with the present invention will depend upon the specific configuration of the process apparatus employed, and thus flow rates in excess of about 30 gallons per minute per square foot of active cathode or less than about 0.05 gallons per minute per square foot of active cathode may be optimal in accordance with various embodiments of the present invention Moreover, electrolyte movement within the cell may be augmented by agitation, such as through the use of mechanical agitation and/or gas/solution injection devices, to enhance mass transfer.

Cell Voltage

In accordance with an exemplary embodiment of the invention, overall cell voltage of from about 0.5 V to about 1.5 V is achieved, preferably from about 0.6 V to about 1.1 V, and more preferably from about 0.7 V to about 0.9 V. Through the use of alternate anode reaction chemistry, overall cell voltages that are generally less than those achievable through conventional electrowinning reaction chemistry may be utilized. The mechanism for optimizing cell voltage within the electrowinning cell will vary in accordance with various exemplary aspects and embodiments of the present invention.

The overall cell voltage achievable generally is dependent upon a number of interrelated factors, including electrode spacing, the configuration and materials of construction of the electrodes, acid concentration and copper concentration in the electrolyte, current density, electrolyte temperature, and, to a smaller extent, the nature and amount of any additives to the electrowinning process (such as, for example, flocculants, surfactants, and the like).

In addition, the present inventors have recognized that independent control of anode and cathode current densities, together with managing voltage overpotentials, can be utilized to enable effective control of overall cell voltage and current efficiency. For example, the configuration of the electrowinning cell hardware, including, but not limited to, the ratio of cathode surface area to anode surface area, can be modified in accordance with the present invention to optimize cell operating conditions, current efficiency, and overall cell efficiency.

Current Density

The operating current density of the electrowinning cell affects the morphology of the copper powder product and directly affects the production rate of copper powder within the cell. In general, higher current density decreases the bulk density and particle size of the copper powder and increases surface area of the copper powder, while lower current density increases the bulk density of copper product (sometimes resulting in cathode copper if too low, which generally is undesirable in a copper powder electrowinning operation). For example, the production rate of copper powder by an electrowinning cell is approximately proportional to the current applied to that cell—a cell operating at, say, 100 A/ft$^2$ of active cathode produces approximately five times as much copper powder as a cell operating at 20 A/ft$^2$ of active cathode, all other operating conditions, including active cathode area, remaining constant. The current-carrying capacity of the cell furniture is, however, one limiting factor. Also, when operating an electrowinning cell at a high current density, the electrolyte flow rate through the cell may need to be adjusted so as not to deplete the available copper in the electrolyte for electrowinning. Moreover, a cell operating at a high current density may have a higher power demand than a cell operating at a low current density, and as such, economics also plays a role in the choice of operating parameters and optimization of a particular process.

In accordance with an exemplary embodiment of the invention, a current density of from about 10 to about 700 amps per square foot of active cathode is maintained, preferably from about 50 A/ft$^2$ to about 150 A/ft$^2$ of active cathode. It should be recognized, however, that the maximum operable current density achievable in accordance with various embodiments of the present invention will depend upon the specific configuration of the process apparatus, the electrolyte flow rate, and other process parameters, and thus an operating current density in excess of 700 A/ft$^2$ of active cathode may be achievable in accordance with the present invention.

Temperature

In accordance with one aspect of an exemplary embodiment of the present invention, the temperature of the electrolyte in the electrowinning cell is maintained at from about 40° F. to about 150° F. In accordance with one preferred embodiment, the electrolyte is maintained at a temperature of from about 90° F. to about 140° F. Higher temperatures may, however, be advantageously employed. For example, in direct electrowinning operations, temperatures higher than 140° F. may be utilized. Alternatively, in certain applications, lower temperatures may advantageously be employed. For example, when direct electrowinning of dilute copper-containing solutions is desired, temperatures below 85° F. may be utilized.

The operating temperature of the electrolyte in the electrowinning cell may be controlled through any one or more of a variety of means well known in the art, including, for example, heat exchange, an immersion heating element, an in-line heating device (e.g., a heat exchanger), or the like, preferably coupled with one or more feedback temperature control means for efficient process control.

Acid Concentration

In accordance with an exemplary embodiment of the present invention, the acid concentration in the electrolyte for electrowinning may be maintained at a level of from about 5 to about 200 grams of acid per liter of electrolyte. In accordance with one aspect of a preferred embodiment of the present invention, the acid concentration in the electrolyte is advantageously maintained at a level of from about 100 to about 180 grams of acid per liter of electrolyte, depending upon the upstream process. Optimally, the acid concentration in the electrolyte is advantageously maintained at a level of from about 150 to about 160 grams of acid per liter of electrolyte.

Copper Concentration

In accordance with an exemplary embodiment of the present invention, the copper concentration in the electrolyte for electrowinning is advantageously maintained at a level of from about 5 to about 40 grams of copper per liter of electrolyte. Preferably, the copper concentration is maintained at a level of from about 10 g/L to about 30 g/L. Optimally, the copper concentration in the electrolyte is advantageously maintained at a level of from about 15 to about 25 grams per liter of electrolyte. However, various aspects of the present invention may be beneficially applied to processes employing copper concentrations above and/or below these levels, with lower copper concentration levels of from about 0.5 to about 5 g/L and upper copper concentration levels of from about 40 g/L to about 50 g/L being applied in some cases.

Iron Concentration

In accordance with an exemplary embodiment of the present invention, the total iron concentration in the electrolyte is maintained at a level of from about 10 to about 60 grams of iron per liter of electrolyte. Preferably, the total iron concentration in the electrolyte is maintained at a level of from about 30 g/L to about 50 g/L, and more preferably, from about 40 g/L to about 50 g/L. It is noted, however, that the total iron concentration in the electrolyte may vary in accordance with various embodiments of the invention, as total iron concentration is a function of iron solubility in the electrolyte. Iron solubility in the electrolyte varies with other process parameters, such as, for example, acid concentration, copper concentration, and temperature. As explained hereinabove, decreasing iron concentration in the electrolyte is generally economically desirable, because doing so decreases iron make-up requirements and decreases the electrolyte sulfate saturation temperature, and thus decreases the cost of operating the electrowinning cell.

In accordance with an exemplary embodiment, wherein direct electrowinning is utilized in connection with the present invention, the total iron concentration in the electrolyte is maintained at a suitable level, preferably as much ferrous iron as can be retained, typically on the order of from about 0.001 to about 10 grams of iron per liter of electrolyte.

As ferrous iron is oxidized at the anode in the electrowinning cell, the concentration of ferrous iron in the electrolyte is naturally depleted, while the concentration of ferric iron in the electrolyte is naturally increased. In accordance with one aspect of an exemplary embodiment of the invention, the concentration of ferrous iron in the electrolyte is controlled by addition of ferrous sulfate to the electrolyte. In accordance with another embodiment of the invention, the concentration of ferrous iron in the electrolyte is controlled by solution extraction (SX) of iron from copper leaching solutions. Ferrous/ferric ions also can be leached from the ore, concentrate, or any other iron source (e.g., pyrite, marcasite, pyrrhotite, scrap iron) to generate additional iron, preferably in the form of ferrous ions that do not require regeneration prior to addition to the electrolyte.

In order for the ferrous/ferric couple to maintain a continuous anode reaction, the ferric iron generated at the anode preferably is reduced back to ferrous iron to maintain a satisfactory ferrous concentration in the electrolyte. Additionally, the ferric iron concentration preferably is controlled to achieve satisfactory current efficiency in the electrowinning cell.

In accordance with an exemplary embodiment, the ferric iron concentration in the electrolyte is maintained at a level of from about 0.001 to about 10 grams of iron per liter of electrolyte. Preferably, the ferric iron concentration in the electrolyte is maintained at a level of from about 1 g/L to about 6 g/L, and more preferably, from about 2 g/L to about 4 g/L.

Figure 3:
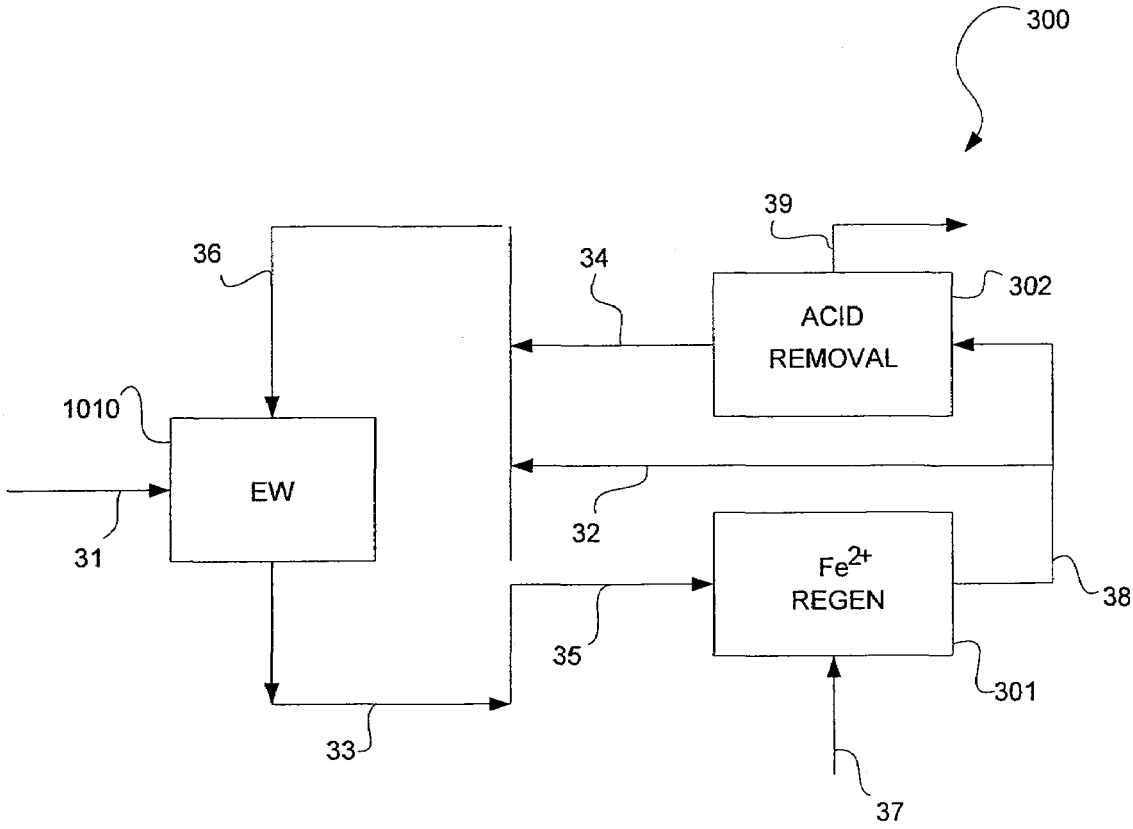
FIG. 3 is a flow diagram illustrating various aspects of an electrowinning process in accordance with an exemplary embodiment of the present invention.

With reference to FIG. 3, in accordance with another aspect of an exemplary embodiment of the invention, the concentration of ferric iron in the electrolyte within the electrowinning cell is controlled by removing at least a portion of the electrolyte from the electrowinning cell, for example, as illustrated in FIG. 3 as electrolyte regeneration stream 35 of process 300.

In accordance with one aspect of an exemplary embodiment of the invention, sulfur dioxide 37 may be used to reduce the ferric iron in electrolyte regeneration stream 35. Although reduction of $Fe^{3+}$ to $Fe^{2+}$ in electrolyte regeneration stream 35 in ferrous regeneration stage 303 may be accomplished using any suitable reducing reagent or method, sulfur dioxide is particularly attractive as a reducing agent for $Fe^{3+}$ because it is generally available from other copper processing operations, and because sulfuric acid is generated as a byproduct. Upon reacting with ferric iron in a copper-containing electrolyte, the sulfur dioxide is oxidized, forming sulfuric acid. The reaction of sulfur dioxide with ferric iron produces two moles of sulfuric acid for each mole of copper produced in the electrowinning cell, which is one mole more of acid than is typically required to maintain the acid balance within the overall copper extraction process, when solution extraction (SX) is used in conjunction with electrowinning. The excess sulfuric acid may be extracted from the acid-rich electrolyte (illustrated in FIG. 3 as stream 38) generated in the ferrous regeneration stage for use in other operations, such as, for example, leaching operations.

With further reference to FIG. 3, the acid-rich electrolyte stream 38 from ferrous regeneration stage 301 may be returned to electrowinning stage 1010 via electrolyte recycle streams 32 and 36, may be introduced to acid removal stage 302 for further processing, or may be split (as shown in FIG. 3) such that a portion of acid-rich electrolyte stream 38 returns to electrowinning stage 1010 and a portion continues to acid removal stage 302. In acid removal stage 302, excess sulfuric acid is extracted from the acid-rich electrolyte and leaves the process via acid stream 39, to be neutralized or, preferably, used in other operations, such as, for example a heap leach operation. The acid-reduced electrolyte stream 34 may then be returned to electrowinning stage 1010 via electrolyte recycle stream 36, as shown in FIG. 3.

In accordance with another aspect of an exemplary embodiment of the invention, the ferric-rich electrolyte is contacted with sulfur dioxide in the presence of a catalyst, such as, for example, activated carbon manufactured from bituminous coal, or other types of carbon with a suitable active surface and suitable structure. The reaction of sulfur dioxide and ferric iron is preferably monitored such that the concentration of ferric iron and ferrous iron in the acid-rich electrolyte stream produced in the ferrous regeneration stage can be controlled. In accordance with an aspect of another embodiment of the invention, two or more oxidation-reduction potential (ORP) sensors are used—at least one ORP sensor in the ferric-rich electrolyte line upstream from the injection point of sulfur dioxide, and at least one ORP sensor downstream from the catalytic reaction point in the ferric-lean electrolyte. The ORP measurements provide an indication of the ferric/ferrous ratio in the solution; however, the exact measurements depend on overall solution conditions that may be unique to any particular application. Those skilled in the art will recognize that any number of methods and/or apparatus may be utilized to monitor and control the ferric/ferrous ratio in the solution. The ferric-rich electrolyte will contain from about 0.001 to about 10 grams per liter ferric iron, and the ferric-lean electrolyte will contain up to about 6 grams per liter ferric iron.

Harvest of Copper Powder

While in situ harvesting configurations may be desirable to minimize movement of cathodes and to facilitate the removal of copper powder on a continuous or semi-continuous basis, any number of mechanisms may be utilized to harvest the copper powder product from the cathode in accordance with various aspects of the present invention. Any device now known or hereafter devised that functions to facilitate the release of copper powder from the surfaces of the cathode to the base portion of the electrowinning apparatus, enabling collection and further processing of the copper powder in accordance with other aspects of the present invention, may be used. The optimal harvesting mechanism for a particular embodiment of the present invention will depend largely on a number of interrelated factors, primarily current density, copper concentration in the electrolyte, electrolyte flow rate, and electrolyte temperature. Other contributing factors include the level of mixing within the electrowinning apparatus, the frequency and duration of the harvesting method, and the presence and amount of any process additives (such as, for example, flocculant, surfactants, and the like).

In situ harvesting configurations, either by self-harvesting (described below) or by other in situ devices, may be desirable to minimize the need to remove and handle cathodes to facilitate the removal of copper powder from the electrowinning cell. Moreover, in situ harvesting configurations may advantageously permit the use of fixed electrode cell designs. As such, any number of mechanisms and configurations may be utilized.

Examples of possible harvesting mechanisms include vibration (e.g., one or more vibration and/or impact devices affixed to one or more cathodes to displace copper powder from the cathode surface at predetermined time intervals), a pulse flow system (e.g., electrolyte flow rate increased dramatically for a short time to displace copper powder from the cathode surface), use of a pulsed power supply to the cell, use of ultrasonic waves, and use of other mechanical displacement means to remove copper powder from the cathode surface, such as intermittent or continuous air bubbles. Alternatively, under some conditions, "self-harvest" or "dynamic harvest" may be achievable, when the electrolyte flow rate is sufficient to displace copper powder from the cathode surface as it is formed, or shortly after deposition and crystal growth occurs.

In accordance with an aspect of one embodiment of the invention, fine copper powder that is carried through the cell with the electrolyte is removed via a suitable filtration, sedimentation, or other fines removal/recovery system.

In general, according to various aspects of the present invention, a process for producing copper powder includes the steps of: (i) electrowinning copper powder from a copper-containing solution to produce a slurry stream containing copper powder particles and electrolyte; (ii) optionally, separating at least a portion of the electrolyte from the copper powder particles in the slurry stream; (iii) conditioning the slurry stream; (iv) optionally, separating the bulk of the liquid from the copper powder particles; and (v) optionally, drying the copper powder particles originally present in the slurry stream to produce a final, stable copper powder product.

Referring again to FIG. 1, in accordance with one aspect of an exemplary embodiment of the invention, copper powder slurry stream 102 from electrowinning stage 1010 optionally is subjected to solid/liquid separation (step 1020) to reduce the amount of electrolyte in stream 102. Optional solid/liquid separation stage 1020 may comprise any apparatus now known or hereafter developed for separating at least a portion of the electrolyte (stream 104) from the copper powder in copper powder slurry stream 102, such as, for example, a clarifier, a spiral classifier, other screw-type devices, a countercurrent decantation (CCD) circuit, a thickener, a filter, a conveyor-type device, a gravity separation device, or other suitable apparatus. In accordance with one aspect of an exemplary embodiment of the invention, the solid/liquid separation apparatus chosen will enable separation of electrolyte from the copper powder while preventing exposure of the copper powder to air, which can cause rapid surface oxidation of the copper powder particles.

In accordance with an optional aspect of an exemplary embodiment of the invention, at least a portion of electrolyte stream 104 leaving solid/liquid separation stage 1020 may be recycled to the electrowinning cell (stream 112) and/or may be combined with lean electrolyte stream 108 (stream 111).

In accordance with one embodiment of the invention, copper powder slurry stream 102 from electrowinning stage 1010 has a solids content of from about 5 percent by weight to about 30 percent by weight. However, the solids content of copper powder slurry stream 102 from electrowinning stage 1010 is largely dependent upon the copper powder harvesting method chosen in electrowinning stage 1010. Preferably, solid/liquid separation stage 1020, when used, is configured to produce a concentrated copper powder slurry stream 103 that has a solids content of at least about 20 percent by weight, and preferably greater than about 30 percent by weight, for example, in the range of about 60 percent to about 80 percent by weight or more depending upon the bulk density and morphology of the copper powder. High solids content may be advantageous, particularly if coarse or granular copper powder is harvested. It is generally desirable to separate as much electrolyte as possible from the copper powder prior to subjecting the copper powder slurry stream to further processing, as doing so potentially reduces the cost of downstream processing (e.g., by reducing process stream volume and thus capital and operating expenses) and potentially increases the quality of the final copper powder product (e.g., by reducing surface oxidation of the copper powder particles by the electrolyte and by reducing levels of entrained impurities).

With continued reference to FIG. 1, in accordance with an exemplary embodiment of the invention, after leaving solid/liquid separation stage 1020, concentrated copper powder slurry stream 103 is subjected to a conditioning stage 1030 to further condition the copper powder in preparation for drying. In accordance with various aspects of an exemplary embodiment, conditioning stage 1030, comprising one or more processing steps, is configured to (i) adjust of the pH of concentrated copper powder slurry stream 103, (ii) stabilize the surface of the copper powder particles to prevent surface oxidation, and/or (iii) further reduce the amount of excess liquid in the copper powder slurry stream to form a moist copper powder product. Adjustment of the pH of concentrated copper powder slurry stream 103 and stabilization of the surface of the copper powder particles in copper powder slurry stream 103 is facilitated by the addition of one or more conditioning agents 105 to conditioning stage 1030.

In accordance with one exemplary aspect of an embodiment of the present invention, conditioning stage 1030 comprises any apparatus now known or hereafter developed capable of achieving the above objectives, and, in particular, capable of treating substantially all surfaces of the copper particles reasonably equally with conditioning agents 105. In accordance with one exemplary embodiment of the invention, conditioning stage 1030 comprises use of a centrifuge. Exemplary processing parameters for conditioning stage 1030 are discussed hereinbelow in connection with another embodiment of the present invention.

In accordance with one aspect of an exemplary embodiment of the present invention, it may be advantageous that a dewatering stage 1040 be employed to enable a bulk of the liquid in copper powder stream 106 to be separated from the bulk of the copper powder as economically as possible. For example, a centrifuge, a filter, or other suitable solid/liquid separation apparatus may be used. In accordance with one aspect of this embodiment of the invention, this separation may be accomplished during and/or in connection with conditioning the copper powder slurry in conditioning stage 1030, such as in connection with conditioning stage 1030 when use of a centrifugal conditioning step is carried out. Alternatively, in certain embodiments, additional dewatering may be desired to yield a copper powder product that is useable for future processing without additional conditioning and/or processing (e.g., drying).

With further reference to FIG. 1, after leaving optional dewatering stage 1040, copper powder stream 107 may be subjected to an optional drying stage 1050 to produce a final copper powder product stream 110. In accordance with an exemplary aspect of an embodiment of the present invention, drying stage 1050 comprises any apparatus now known or hereafter developed capable of drying the copper powder sufficiently for packaging as a final product and/or for transfer to downstream process and for downstream processing steps for formation of alternative copper products. For example, drying stage 1050 may comprise a flash dryer, a cyclone, a dry sintering apparatus, a conveyor belt dryer, and/or other suitable apparatus. Furthermore, in cases where the copper powder is to be melted (e.g., rod mill, shaft furnace, etc.), then the excess heat from the melting process may be used beneficially to dry the copper powder product.

In accordance with another exemplary embodiment of the invention, a process for producing copper powder includes the steps of (i) electrowinning copper powder from a copper-containing solution to produce a slurry stream containing copper powder particles and electrolyte; (ii) optionally, separating at least a portion of the electrolyte from the copper powder particles in the slurry stream; (iii) optionally, separating one or more coarse copper powder particle size distributions in the slurry stream from one or more finer copper powder particle size distributions in the slurry stream in one or more size classification stages; (iv) optionally, conditioning the slurry stream; (v) separating the bulk of the liquid from the copper powder particles; (vi) optionally, drying the copper powder particles in the slurry stream to produce a dry copper powder stream; (vii) optionally, separating one or more coarse copper powder particle size distributions in the dry copper powder stream from one or more finer copper powder particle size distributions in the dry copper powder stream in one or more size classification stages; and (viii) either collecting the copper powder final product from the process or subjecting the copper powder stream to further processing (such as, for example, briquetting, extrusion, melting, or other downstream processes).

Figure 2:
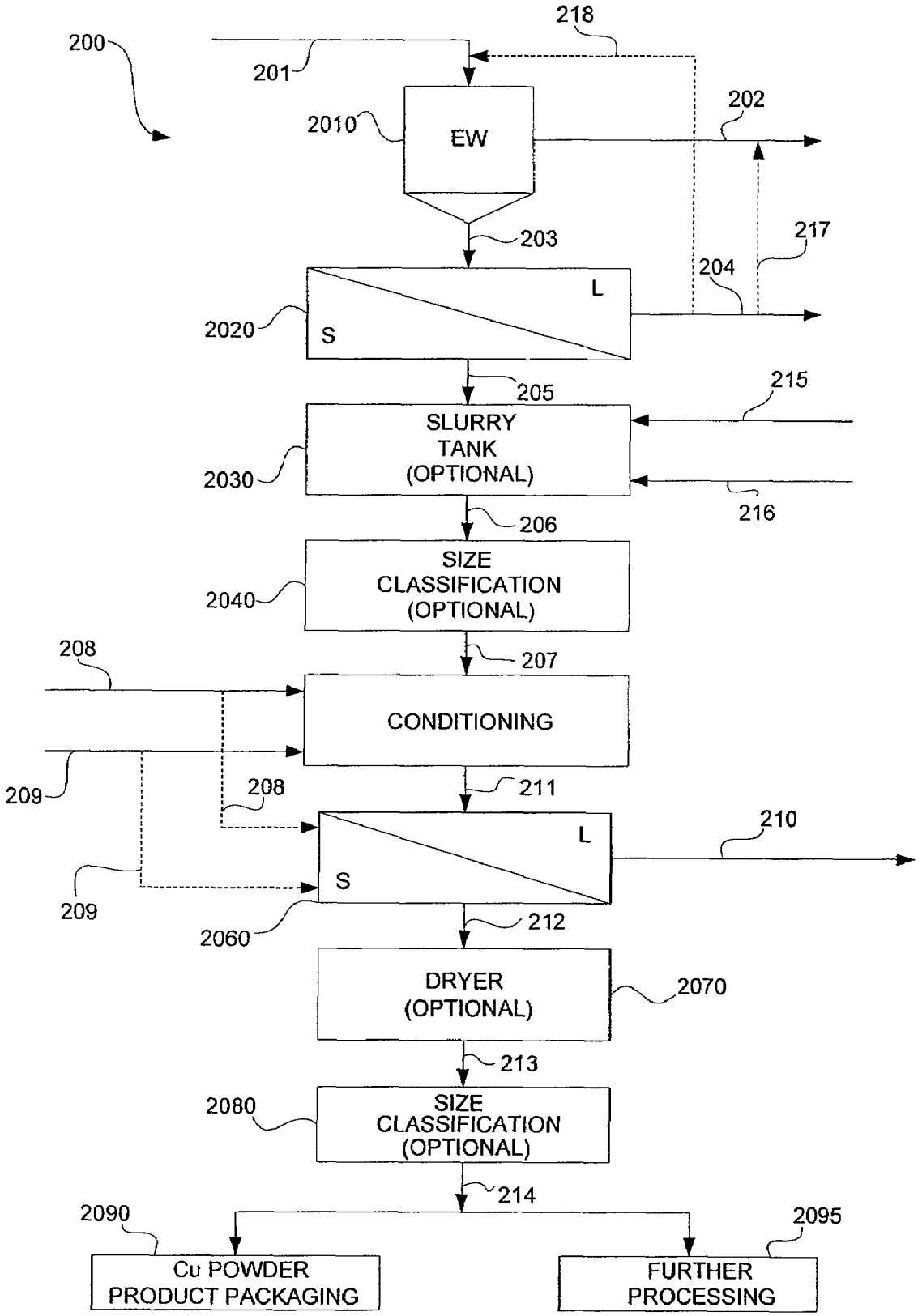
FIG. 2 is a flow diagram illustrating various aspects of a process for producing copper powder in accordance with another exemplary embodiment of the present invention.

Turning now to FIG. 2, copper powder process 200 exemplifies various aspects of another embodiment of the present invention. In accordance with the illustrated embodiment, a copper-containing solution 201 is provided to an electrowinning stage 2010. Electrowinning stage 2010 is configured to produce a copper powder slurry stream 203, which comprises copper powder and an electrolyte, and a lean electrolyte stream 202. Lean electrolyte stream 202 may be recycled to upstream processing operations (such as, for example, an upstream leaching operation used to produce copper-containing solution 201), used in other processing operations, or impounded or disposed of. In cases where the copper product is to be melted, for example, in a rod meld shaft furnace, then the excess heat from the melting process may be used beneficially to dry the said copper product.

In accordance with one aspect of an exemplary embodiment of the invention, copper powder slurry stream 203 then optionally undergoes solid/liquid separation in solid/liquid separation (or "dewatering") stage 2020, which may, as described above in connection with FIG. 1, comprise any apparatus now known or hereafter developed for separating at least a portion of the bulk electrolyte (stream 204) from the copper powder in copper powder slurry stream 203, such as, for example, a clarifier, a spiral classifier, a screw-type device, a countercurrent decantation (CCD) circuit, a thickener, a filter, a gravitational separator device, a conveyor-type device, or other suitable apparatus. Such an advantageous bulk liquid removal step may yield a copper powder product that is useable for future processing without additional conditioning and/or processing. Preferably, semi-continuous copper powder harvesting within the electrowinning cell is advantageously matched with batch downstream processing (i.e., dewatering and conditioning) such that copper powder product is more continuously recovered. For example, multiple solid/liquid separation devices may be employed in connection with a conditioning stage, and as such, downstream solid/liquid separation may be eliminated.

With further reference to FIG. 2, in accordance with an optional aspect of an embodiment of the present invention, the resulting concentrated copper powder slurry from solid/liquid separation stage 2020 (stream 205) may be collected in a copper powder slurry tank 2030. Copper powder slurry tank 2030 is configured to hold the concentrated copper slurry and to maintain homogeneity of the slurry through mixing, agitation, or other means. Additionally, process water 215 and/or a pH-adjusting agent 216 (such as, for example, ammonium hydroxide) may optionally be added to copper powder slurry tank to aid in maintaining homogeneity of the slurry, stabilizing the copper powder in the slurry, and/or adjusting the pH of the slurry in preparation for further processing. In accordance with another aspect of an exemplary embodiment of the invention, slurry tank 2030 is configured such that the copper powder slurry is not exposed to air during storage and/or treatment, as such exposure may, as described above, detrimentally affect the surface integrity of the copper powder particles.

Upon discharge from slurry tank 2030, slurry stream 206 may, optionally, undergo a size classification stage 2040. If utilized, the objective of size classification stage 2040 is to separate coarser copper powder particles from finer copper powder particles in the slurry stream, in accordance with specifications for the desired final copper powder product. For example, if the final copper powder product is to be used for extruding copper shapes or other products, such as by direct rotary extrusion, a slurry stream comprising finer copper powder particles is preferred, whereas if the final copper powder product is to be melted for rod or other product formation, relatively coarse copper powder particles may be preferable. As used herein, the term "coarse" describes copper powder particles larger than about 200 microns (in the range of about plus 100 mesh). The term "fine" is used herein to describe copper powder particles smaller than about 50 microns (in the range of about minus 325 mesh). Particles between those ranges are referred to as "intermediate" particles.

When size classification is desired, it may be carried out at any suitable stage in the copper powder production process, the suitability of any stage being dependent upon a variety of factors, including the size of the copper powder particles leaving the electrowinning stage, the configuration and materials of construction of the size classification apparatus, and other engineering and economic process considerations.

In accordance with an exemplary embodiment of the invention, when utilized, size classification may be conducted on the slurry stream leaving the electrowinning cell, the optional slurry tank (prior to conditioning), and/or on the copper powder product stream. Such processing may allow for stabilization of fine particles and different treatment of coarser particles. In the event size classification is conducted, the different particle size distributions, or, if desired, various mixtures thereof, may be processed further, as will now be discussed.

Referring again to FIG. 2, in accordance with an exemplary embodiment of the invention, after leaving the optional size classification stage 2040, slurry stream 207 (or slurry stream 206, if size classification is not utilized) is subjected to an optional conditioning operation 2050 to condition the copper powder and/or the solution in preparation for dewatering and optional drying. In accordance with one exemplary aspect of an embodiment of the present invention, conditioning operation 2050, when used, may be performed in conjunction with a dewatering operation 2060.

In accordance with one embodiment of the present invention, optional conditioning operation 2050 may include washing, pH adjustment, removal of impurities, stabilization, and/or other conditioning operations.

In accordance with an exemplary embodiment of the invention, the copper slurry may be contacted with a washing agent 208 and/or a stabilizing agent 209. Washing agent 208 can comprise any liquid material, water, ammonium hydroxide, and/or mixtures thereof. Optionally, washing agent 208 may include additional materials, such as, for example, surfactants, soaps, and the like. In accordance with one aspect of an exemplary embodiment of the invention, washing agent 208 may be heated prior to washing, which may enhance impurity removal. Stabilizing agent 209 may be any agent suitable for preventing surface oxidation of the copper powder particles (which oxidation may diminish the value and/or quality of the copper powder product and/or may negatively impact downstream operations or applications).

In accordance with various aspects of an exemplary embodiment, stabilizing agent 209 comprises an organic surfactant in combination with a stabilizer. The organic surfactant may be used to lower the surface tension of the stabilizer and thus enable the stabilizer to penetrate into all pores of the copper powder particles. The stabilizer, on the other hand, preferably is the "active" agent that coats the particles and prevents oxidation, thus providing a suitable shelf life to the copper powder product and enabling transfer of the copper powder in an otherwise oxidizing atmosphere (i.e., air). Some suitable stabilizers include, for example, 1,2,3-Benzotriazole (BTA), animal glue, fish glue, soaps, and the like. Under certain circumstances, however, the use of a stabilization agent may be unnecessary, such as when the copper powder product is intended to be processed immediately after production (by melting and casting, for example). Moreover, other methods of preventing surface oxidation of the copper powder particles during processing may reduce or eliminate the need for a stabilization agent, such as, for example, use of a charged fluidized bed or use of nitrogen blanketing during one or more stages of copper powder handling. If it is desirable to store the copper powder product for an extended period of time, however, then a stabilizing agent may be desired.

In accordance with an exemplary aspect of an embodiment of the present invention, it is advantageous that a dewatering stage 2060 be employed to enable a bulk of the liquid in copper powder stream 211 to be separated from the bulk of the copper powder as economically as possible. For example, a centrifuge, a filter, or other suitable solid/liquid separation apparatus may be used.

In accordance with one aspect of this embodiment of the invention, this separation may be accomplished during or in connection with conditioning the copper powder slurry, such as in connection with optional conditioning operation 2050. Such an advantageous dewatering step may yield a copper powder product that is useable for future processing without additional conditioning and/or processing (e.g., drying). In accordance with an exemplary embodiment, after the copper powder is washed and stabilized, a dewatering stage 2060 is utilized to draw as much liquid from copper powder slurry 211 as possible, producing a moist copper powder stream 212. Moist copper powder stream 212 may then be subjected to an optional drying stage 2070 to produce a final copper powder product stream 213.

In accordance with an exemplary aspect of an embodiment of the present invention, optional drying stage 2070 comprises any apparatus now known or hereafter developed capable of drying the copper powder sufficiently for packaging as a final product and/or for shipping to downstream process and for downstream processing steps for formation of alternative copper products. For example, drying stage 2070 may comprise a flash dryer, a fluid bed dryer, a rotary dryer, a cyclone, a dry sintering apparatus, a conveyor belt dryer, and/or other suitable apparatus for direct or indirect drying. In accordance with an exemplary embodiment, optional drying stage 2070 comprises a flash dryer that enables rapid drying of the copper powder particles without disturbing the integrity of the stabilizer coating on the copper powder particles. In drying stage 2070, moist copper powder stream 212 is contacted with sufficient hot air for a period of time sufficient to reduce the moisture content of the copper powder particles. The final moisture content of the copper powder product stream 213 may vary, depending upon the nature of any downstream processing of the copper powder (through, for example, size classification, packaging, direct forming of copper shapes and rods, casting, briquetting, and the like). In this regard, in certain applications, significant moisture content may be retained without deleteriously impacting subsequent processing.

As mentioned above, and with further reference to FIG. 2, after leaving optional drying stage 2070, copper powder product stream 213 may optionally undergo size classification in size classification stage 2080 to achieve a desired particle size distribution in the final copper powder product 214. The final copper powder product 214 may then be sent to a packaging operation 2090—for example, a bagging operation—or may be subjected to further processing 2095 to change the character of the final copper product.

EXAMPLES

A number of experiments were conducted in accordance with various aspects of exemplary embodiments of the present invention using alternative anode reaction chemistries. In particular, experimentation sought to evaluate harvestability conditions of copper powder in an electrowinning cell. Cathode configurations used were of a flow-through design and incorporated stainless steel and titanium rods with varying diameters, cross-sectional geometries, and surface finishes. The cathode immersed plating depth was 29 inches. Anodes used were constructed of expanded titanium mesh with an iridium oxide-based coating. Various electrolyte flow tubes were attached to the electrowinning cell to test different electrolyte injection geometries. In the experiments conducted, electrolyte flow was evenly distributed across the front of the cell. The electrolyte therefore flowed through the electrodes, not from side to side. A recirculation tank with an immersion heater and pump were attached to the electrowinning cell to provide electrolyte to the cell. Process variables studied included current density, electrolyte flow rate, copper concentration, and iron concentration.

As described below and as illustrated in FIGS. 4 through 9, the conditions that most favored copper powder formation on the cathode included low copper concentration, high current density, small diameter cathode rods, the use of titanium cathodes, and low electrolyte flow rate. Conditions were found where copper powder that is easily harvestable can be produced.

Table 1 contains the experimental design. Fixed variables for this design included electrolyte chemistry (44 to 48 g/L copper, 22 to 26 g/L iron, 150 to 160 g/L sulfuric acid), and electrolyte temperature of 120° F. Dependent variables (measured variables) were cell voltage and the harvestability of the copper powder produced (i.e., whether the electrowon copper was easily removed as powder, or whether it formed pseudo-cathode, a cathode-powder intermediate that tends to stick to the cathode). As the experimental results were obtained, new tests were designed to explore specific areas of interest. As a result of the electrolyte chemistry and the anodes utilized in this testing, the anode reaction in the cell was the oxidation of ferrous to ferric iron.

TABLE 1

Exploratory experiment design for copper powder production.

| Current Density, A/ft$^2$ | Electrolyte Flow Rate, Gpm | Cathode Material of Construction | Cathode Rod Diameter, inches |
|---|---|---|---|
| 300 | 10 | 316 Stainless Steel | ⅛ |
| 600 | 50 | Titanium | ¾ |

The harvesting method utilized in each test was to open 1-inch side flow ports on the side of the electrowinning cell one by one for a short period of time. This imposed an electrolyte flow of approximately 20 gpm on individual sections of the cathode rods, causing the electrowon copper powder to fall off the cathode rods. If residual powder remained on the cathode rods at the end of the harvest cycle, the entire cathode was lifted and the powder was removed by hand. Harvest cycles were typically 1 to 2 hours.

Figure 4:
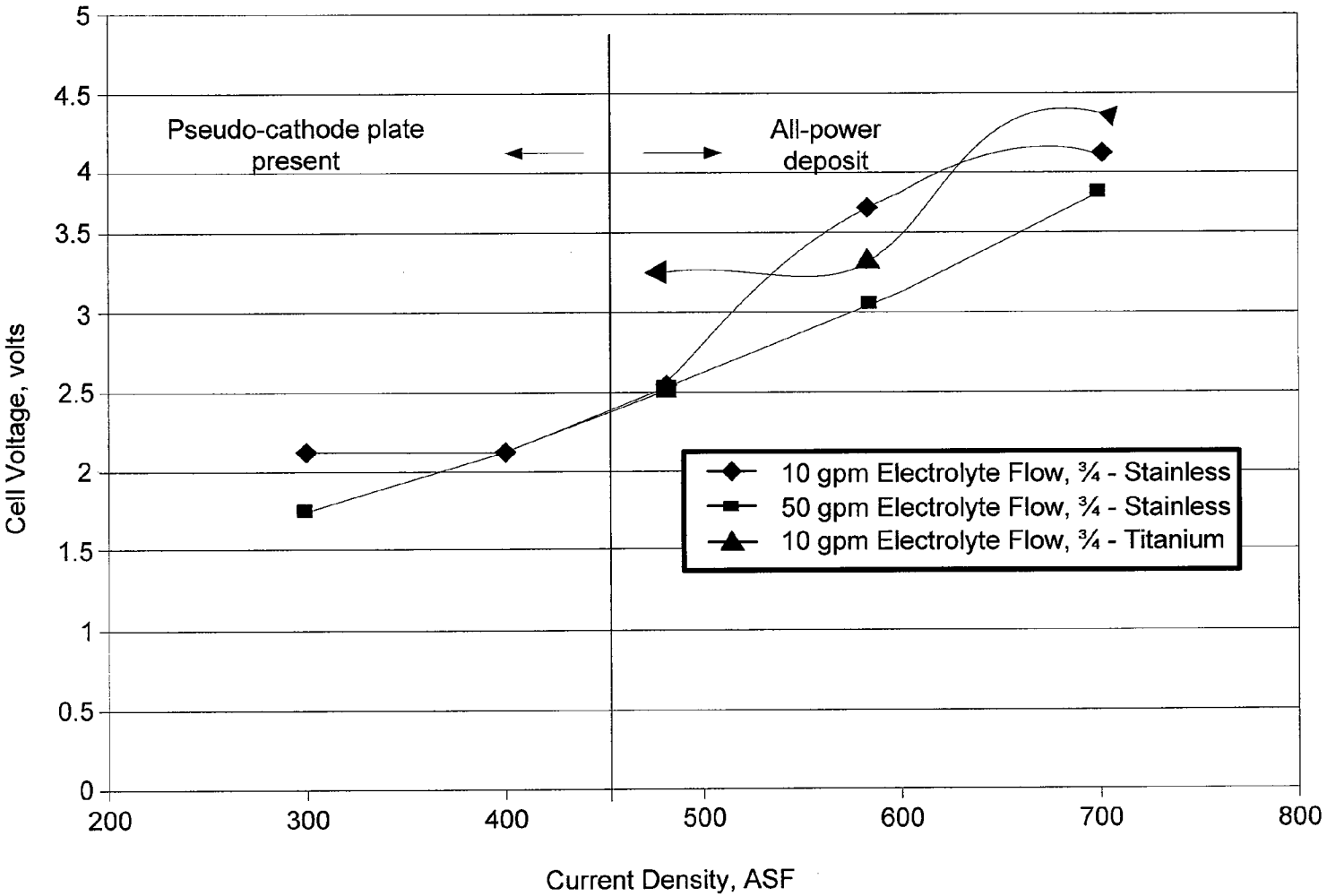
FIGS. 4 through 9 illustrate results from experimentation with various cathode configurations and process parameters in accordance with various aspects of exemplary embodiments of the present invention.
Figure 5:
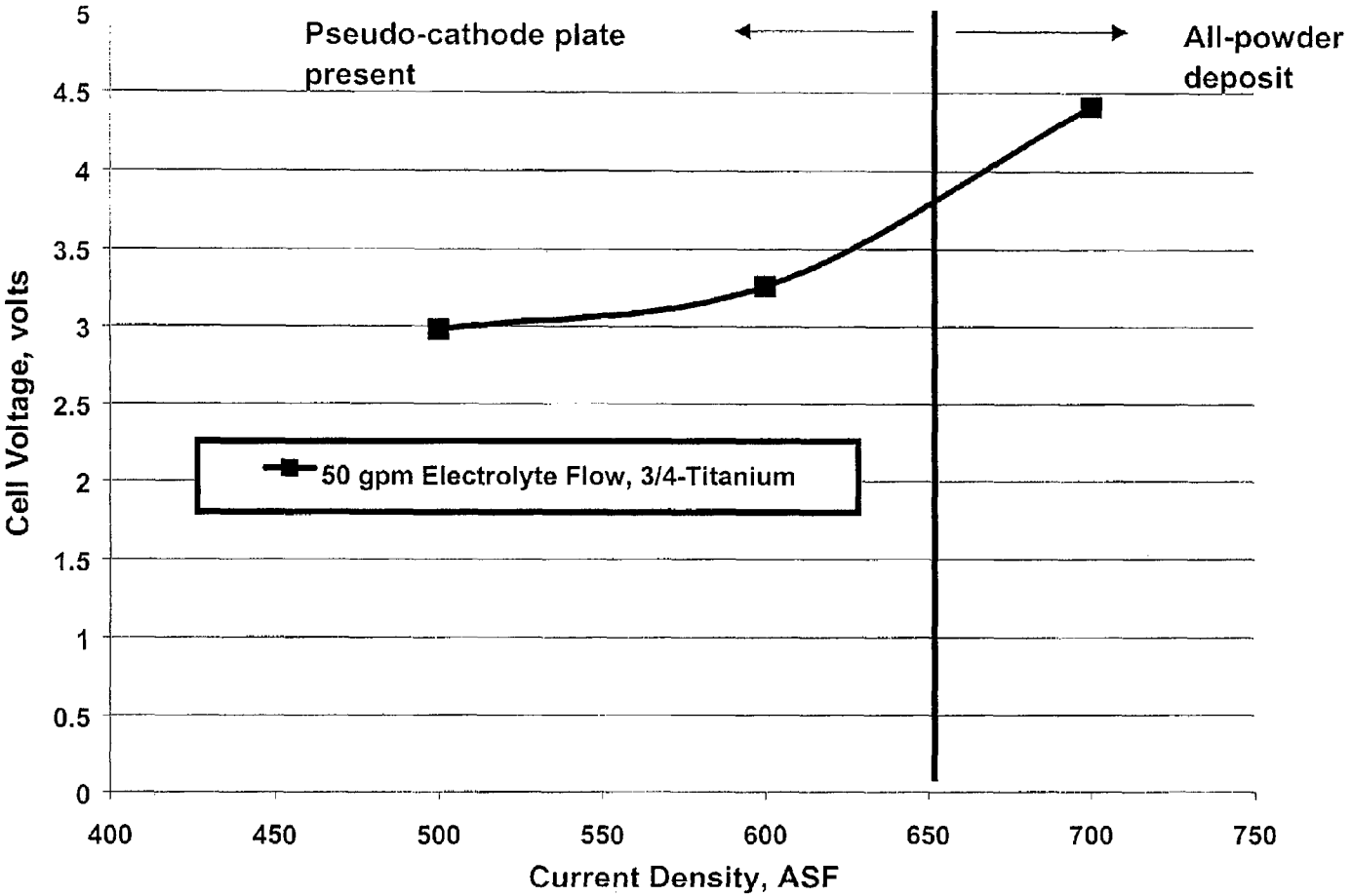

FIG. 4 illustrates the effect of current density on cell voltage and copper powder harvestability using ¾-inch stainless steel or ¾-inch titanium cathode rods, an electrolyte flow rate of 10 or 50 gpm, and an electrolyte containing 44 to 48 g/L copper, 22 to 26 g/L iron, 150 to 160 g/L sulfuric acid, and maintained at a temperature of 120° F. Additional current density points were added to the experiment design because of the pseudo-cathode plate that was evident at an operating current density of 300 A/ft$^2$. The transition from pseudo-cathode to an all-powder copper deposit occurred between about 400 A/ft$^2$ and about 500 A/ft$^2$ at both 10 and 50 gpm electrolyte flow using stainless steel cathode rods. Cell voltage increased to above 2.5 volts at 500 A/ft$^2$. Oxygen evolution was evident at the anode at 600 and 700 A/ft$^2$, indicating insufficient ferrous iron concentration in the electrolyte to maintain the ferrous/ferric anode reaction at these current densities.

Titanium cathode rods were tested at 500, 600, and 700 A/ft$^2$ for comparison. At 10 gpm electrolyte flow, the titanium rod cathode exhibited an all-powder deposit and the electrowon copper powder was more easily harvested than when the ¾-inch stainless steel rod cathode was tested under the same conditions. The test results with the ¾-inch titanium cathode rods at 50 gpm are set forth in FIG. 5. When flow was increased from 10 to 50 gpm using the ¾-inch titanium rod cathode, pseudo-cathode plate was evident at 500 and 600 A/ft$^2$, whereas at 10 gpm electrolyte flow, the electrowon copper was an all-powder deposit. A current density of 700 A/ft$^2$ was required at the higher flow rate to produce an all-powder deposit.

Figure 6:
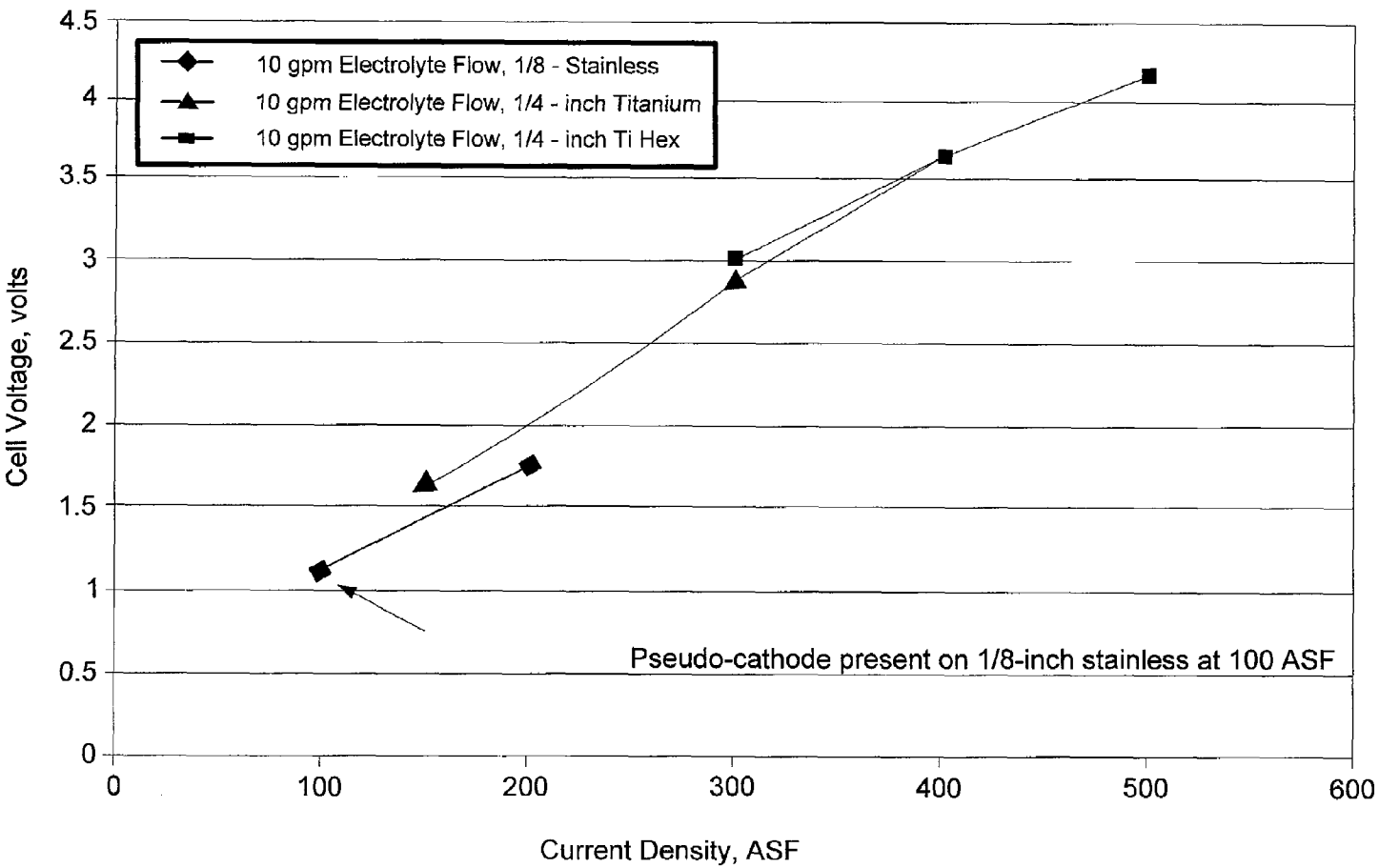

FIG. 6 sets forth the results obtained using smaller diameter cathode rods. In these experimental tests, ⅛-inch diameter titanium rods were not immediately available, and so ¼-inch rods were substituted. A ¼-inch hexagonal titanium rod cathode was also tested. The tests were conducted at 10 gpm electrolyte flow only. As the results in FIG. 6 demonstrate, when using a cathode with smaller diameter rods, a lower current density can be operated while still maintaining an all-powder copper deposit. Pseudo-cathode plate was observed on the ⅛-inch stainless steel cathode rods at an operating current density of 100 A/ft$^2$, but not in the other tests displayed in FIG. 6.

Figure 7:
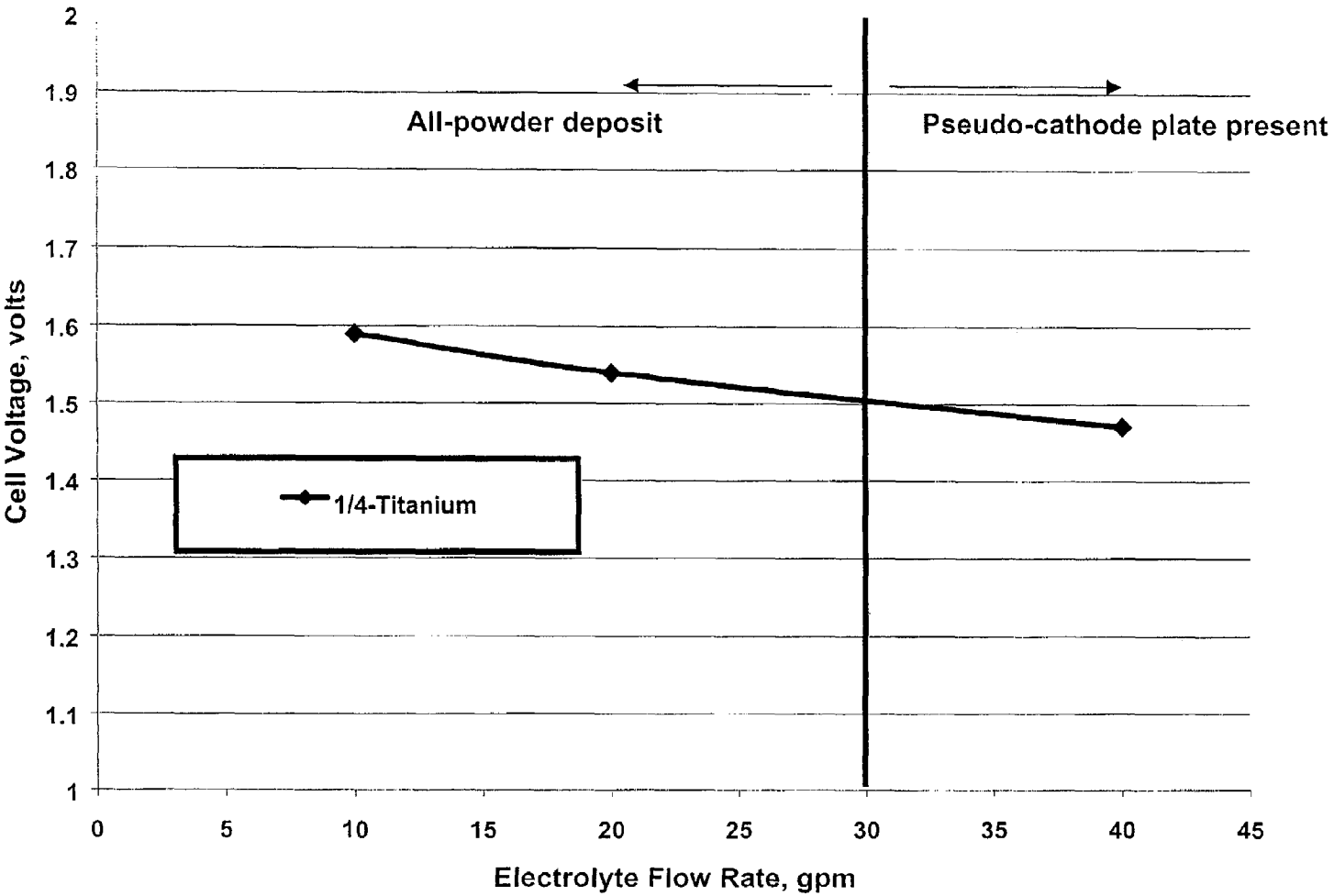
Figure 8:
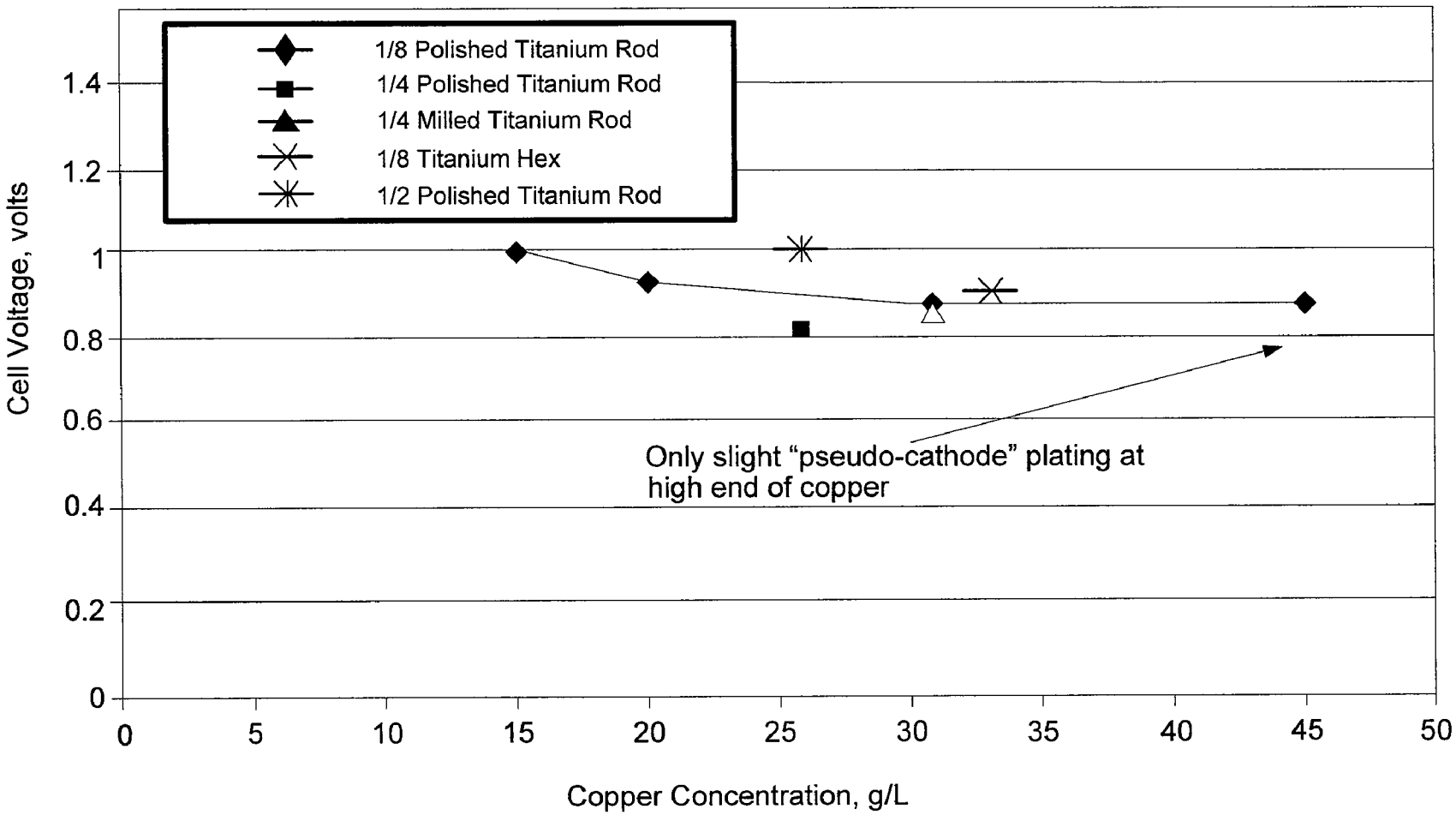

Additional tests with ¼-inch titanium rod cathodes were completed to observe whether changes in electrolyte flow rate could be used to cause copper powder to fall off the cathode rods over time as the powder particles grew in size. To facilitate this, the copper concentration in the electrolyte was decreased to 26 g/L. Iron concentration in the electrolyte was increased to 40 g/L to help lower the cell voltage. A current density of 150 A/ft$^2$ was utilized. The results are shown in FIG. 7. As can be seen in FIG. 7, increasing electrolyte flow rate to 40 gpm caused pseudo-cathode to form. At electrolyte flow rates of 10 and 20 gpm, an all-powder deposit was produced, but the copper powder did not fall off cathode rods spontaneously. However, the copper powder was removed very easily from the cathode rods at the lower flow rates.

Smaller diameter titanium rod cathodes with polished surfaces (versus standard milled surfaces) were then tested. In order to lower cell voltage to 1 volt or less, a current density of 100 A/ft$^2$ and an electrolyte iron concentration of 30 to 40 g/L were used. Copper concentration was varied from 45 g/L to 15 g/L (with the ⅛-inch polished titanium cathode) to observe whether the copper powder would begin to harvest spontaneously at an electrolyte flow rate of 10 gpm. The results are set forth in FIG. 8. The copper produced was an all-powder deposit and cell voltage was maintained at less than 1.0 V, but the powder did not self-harvest. At a copper concentration of 45 g/L in the electrolyte, only slight pseudo-cathode plating was observed on the ⅛-inch polished titanium cathode.

Figure 9:
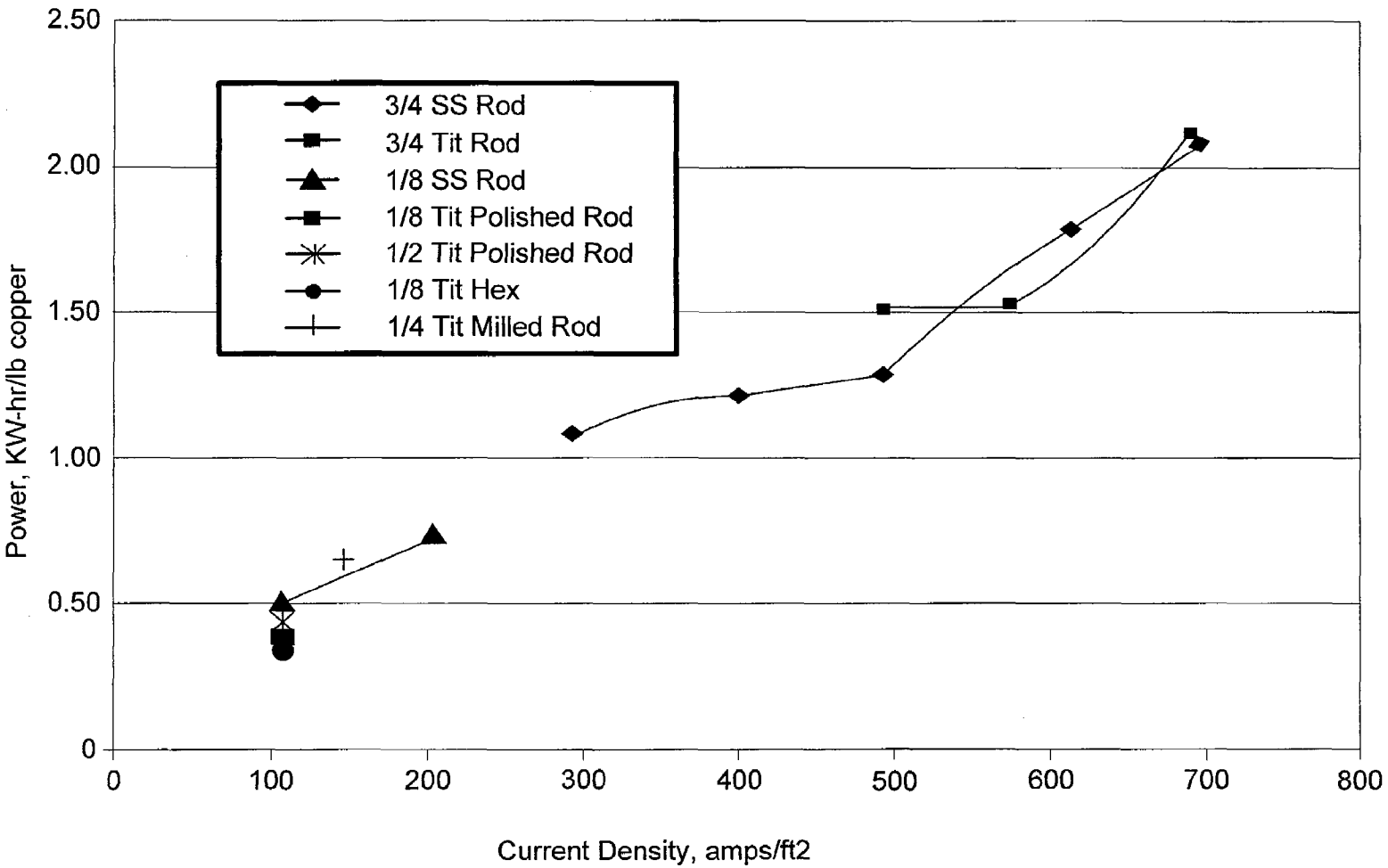

FIG. 9 is a summary showing electrowinning power consumption as a function of current density at 10 gpm electrolyte flow rate and 120° F. In order to operate at less than 0.5 W-hr/lb copper, a current density of 100 A/ft$^2$ is indicated.

The present invention has been described above with reference to a number of exemplary embodiments. It should be appreciated that the particular embodiments shown and described herein are illustrative of the invention and its best mode and are not intended to limit in any way the scope of the invention. Those skilled in the art having read this disclosure will recognize that changes and modifications may be made to the exemplary embodiments without departing from the scope of the present invention. For example, various aspects and embodiments of this invention may be applied to electrowinning of metals other than copper, such as nickel, zinc, cobalt, and others. Although certain preferred aspects of the invention are described herein in terms of exemplary embodiments, such aspects of the invention may be achieved through any number of suitable means now known or hereafter devised. Accordingly, these and other changes or modifications are intended to be included within the scope of the present invention.

What is claimed is:

1. A system for producing copper powder by electrowinning comprising:

an electrolyte stream, wherein said electrolyte stream comprises copper and solubilized ferrous iron;

an electrowinning cell, wherein said electrowinning cell comprises at least one flow-through anode and at least one flow-through cathode;

wherein said electrowinning cell is configured to operate at a current density of at least 26 amperes per square foot of active cathode;

wherein said electrowinning cell is configured to oxidize at least a portion of said solubilized ferrous iron in said electrolyte stream from ferrous iron to ferric iron at the at least one flow-through anode;

wherein said flow-through electrowinning cell is configured to operate at an overall cell voltage of less than about 1.5V.

2. The system of claim 1, further comprising an electrolyte flow manifold for introducing said electrolyte stream into said electrowinning cell.

3. The system according to claim 2, wherein said electrolyte flow manifold is configured to maintain an electrolyte flow rate to said electrowinning cell of from about 0.05 gallons per minute per square foot of active cathode to about 30 gallons per minute per square foot of active cathode.

4. The system according to claim 1, wherein said electrolyte stream has a total iron concentration of from about 10 g/L to about 60 g/L.

5. The system according to claim 1, wherein said electrolyte stream has a copper concentration of from about 5 g/L to about 40 g/L.

6. The system according to claim 1, wherein said electrolyte stream has an acid concentration of from about 5 g/L to about 200 g/L.

7. The system according to claim 1, wherein said electrolyte stream has a temperature in the range of from about 40° F. to about 150° F.

8. The system according to claim 1, further comprising a regeneration vessel configured to reduce at least a portion of said ferric iron to ferrous iron to form a regenerated electrolyte stream.

9. The system according to claim 8, wherein said regeneration vessel contains a catalyst.

10. The system according to claim 9, wherein said catalyst is activated carbon.

11. The system according to claim 8, wherein said regeneration vessel further contains sulfur dioxide gas.

12. The system according to claim 1, wherein said electrolyte stream further comprises ferric iron in a concentration from about 0.001 g/L to about 10 g/L.

13. The system according to claim 1, wherein said at least one flow-through anode comprises an anode comprising a metal mesh with an electrochemically active coating.

14. The system according to claim 1, wherein said at least one flow-through anode comprises an anode comprising titanium mesh with an iridium-oxide based coating.

15. The system according to claim 1, wherein said at least one flow-through anode comprises an anode comprising titanium mesh with a ruthenium-oxide based coating.

16. The system according to claim 1, wherein said at least one flow-through anode comprises at least one of a carbon composite, a graphite rod, and a metal-graphite sintered material.

17. The system according to claim 1, wherein said at least one flow-through anode comprises a plurality of stainless steel rods.

18. The system according to claim 1, wherein said at least one flow-through cathode is comprised of at least one of a plurality of parallel metal wires, a plurality of thin rods, a plurality of parallel metal strips, a metal mesh, an expanded porous metal structure, a metal wool and a conductive polymer.

19. The system according to claim 18, wherein said at least one flow-through cathode is polished.

* * * * *